US007862374B2

(12) United States Patent
Ichio et al.

(10) Patent No.: US 7,862,374 B2
(45) Date of Patent: Jan. 4, 2011

(54) CONNECTOR HAVING A LOCKING LANCE

(75) Inventors: Toshifumi Ichio, Yokkaichi (JP); Kenji Okamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/487,867

(22) Filed: Jun. 19, 2009

(65) Prior Publication Data

US 2010/0009568 A1 Jan. 14, 2010

(30) Foreign Application Priority Data

Jul. 8, 2008 (JP) ..... 2008-178372
May 15, 2009 (JP) ..... 2009-119248

(51) Int. Cl.
*H01R 13/40* (2006.01)

(52) U.S. Cl. ..... 439/595; 439/752

(58) Field of Classification Search ..... 439/189, 439/511, 595, 752
See application file for complete search history.

(56) References Cited

U.S. PATENT DOCUMENTS 3,917,371 A 11/1975 Hirokawa
4,679,874 A * 7/1987 Saijo et al. ..... 439/595
4,690,477 A * 9/1987 Doutrich et al. ..... 439/595
5,456,617 A 10/1995 Chishima
5,749,753 A * 5/1998 Chishima et al. ..... 439/752.5
5,769,663 A 6/1998 Kodama
6,068,512 A * 5/2000 Sugie ..... 439/595
6,093,063 A * 7/2000 Tsuji et al. ..... 439/752
6,146,200 A * 11/2000 Ito et al. ..... 439/596
6,290,521 B1 9/2001 Suzuki
6,328,614 B1 * 12/2001 Osawa ..... 439/752
7,520,767 B2 * 4/2009 Tamagawa et al. ..... 439/189
2001/0006861 A1 7/2001 Ohsumi

FOREIGN PATENT DOCUMENTS

JP 2004-014220 1/2004

* cited by examiner

*Primary Examiner*—Thanh-Tam T Le
(74) *Attorney, Agent, or Firm*—Gerald E. Hespos; Michael J. Porco

(57) ABSTRACT

Locking lances (12) are formed at an outer wall (10B) of a housing (10) and are resiliently deformable between engaging positions to engage terminals (20) and disengaging positions outward from the engaging positions to permit the insertion and withdrawal of the terminals (20). Leading end surfaces (12B) of the locking lances (12) are inclined to project gradually forward toward an inner side of the housing (10). A facing surface (15A) of the outer wall (10B) of the housing 10 facing the leading end surfaces (12B) of the locking lances 12 is inclined to project gradually toward the locking lances (12) at more outward positions on the housing (10). The leading end surfaces (12B) of the locking lances (12) contact the facing surface (15A) when the locking lances (12) are deformed outward beyond the disengaging positions.

20 Claims, 22 Drawing Sheets

CONNECTOR HAVING A LOCKING LANCE

BACKGROUND OF THE INVENTION

1. Field of the Invention

The invention relates to a connector formed with a locking lance in an outer wall of a housing.

2. Description of the Related Art

Japanese Unexamined Patent Publication No. 2004-14220 and other known prior art show connectors that have a housing and a terminal held in the housing by a locking lance. The locking lance of Japanese Unexamined Patent Publication No. 2004-14220 is formed at an outer wall of the housing and is resiliently deformable in inward and outward directions of the housing. The locking lance is deformed outwardly upon inserting a terminal into a cavity, but resiliently returns inwardly toward to engage the terminal when the terminal reaches a proper position in the cavity. A jig can engage the leading end of the locking lance to deform the locking lance outwardly and out of engagement with the terminal so that the terminal can be withdrawn from the cavity. However, the jig can cause the locking lance to be deformed excessively and damaged or broken.

The invention was developed in view of the above situation and an object thereof is to provide a connector capable of preventing a locking lance from being excessively deformed.

SUMMARY OF THE INVENTION

The invention relates to a connector with a housing that is formed internally with at least one cavity capable of accommodating at least one terminal. The housing is formed with at least one locking lance for engaging and retaining the terminal that has been inserted into the cavity. The locking lance is formed at an outer wall of the housing and is resiliently deformable between an engaging position to be engaged with the terminal and a disengaging position reached by an outward resilient deformation from the engaging position to permit insertion and withdrawal of the terminal. A leading end surface of the locking lance is inclined to gradually project forward toward an inner side of the housing. The outer wall of the housing has a facing surface that substantially faces the leading end surface of the locking lance. The facing surface is inclined to project gradually toward the locking lance toward an outer side of the housing. The leading end surface of the locking lance contacts the facing surface when the locking lance is deformed resiliently out beyond the disengaging position. Thus, the locking lance will not deform excessively out beyond the disengaging position.

The locking lance preferably does not project out from the housing when the locking lance is at the engaging position. However, the terminal that has not yet reached the proper position in the cavity preferably engages the locking lance and urges the locking lance out from the housing. Accordingly, a detecting jig can be slid along the outer wall of the housing after the terminal is inserted into the housing. The detecting jig contacts the locking lance if the terminal has not reached the proper position in the cavity (i.e. if the terminal is inserted insufficiently). However, the jig does not contact the locking lance if the terminal is at the proper position. In this way, insufficient insertion of the terminal can be detected.

At least one catch may be provided at or near the leading end surface of the locking lance and may be engageable with a jig. The engagement of the jig with the leading end surface of the locking lance enables the locking lance to be deformed resiliently. Thus, the jig cannot slide on the leading end surface of the locking lance and the locking lance can be disengaged easily.

The catch may be provided in the widthwise center of the locking lance. Accordingly, a force of the jig for resiliently deforming the locking lance acts on the locking lance in a well-balanced manner. Therefore the locking lance can be disengaged easily.

The catch may comprise at least one recess formed in the front end surface of the locking lance. A recessing direction of the recess is substantially parallel to the outer wall of the housing when the locking lance is at the engaging position.

An inclination of the facing surface may be substantially equal to an inclination of the front end surface of the locking lances.

An inclination of the front end surface of the locking lance may be substantially equal to an inclination of an engageable portion of the terminal.

A detecting jig may be slid along the outer wall of the housing after the terminal has been inserted into the cavity. The detecting jig will contact the front end surface of the locking lance if the terminal is inserted insufficiently and hinders sliding movement of the detecting jig. However, the detecting jig may be slid along the outer surface of the housing without being hindered by the locking lance if the terminal is at the proper position of the cavity.

At least one opening may be formed in the outer wall for exposing the cavity to the outer side of the housing.

A clearance between the leading end surface of the locking lance and the opening may serve as a jig hole for receiving a jig.

The invention also relates to a wiring harness that enables at least one device-side wire to be connected with at least one main line formed by bundling a plurality of branch lines. The wiring harness preferably comprises the above described connector, the main line, a fixing member for fixing the connector to the outer surface of the main line, and at least one busbar in the connector for shorting the device-side wire with the branch line drawn out from the main line. The branch line drawn out from the main line preferably is connected with the connector beforehand. It is sufficient merely to connect the device-side wire with the connector for branch-connecting the branch line with the device-side wire. Thus, the branch line is branch-connected with the device-side wire via the busbar, and a device can be attached later if necessary.

The invention also relates to a wiring harness that enables at least one device-side wire to be connected with at least one main line formed by bundling a plurality of branch lines. At least one busbar for shorting wires is provided in the above-described connector. The branch line drawn out from the main line is connected with the connector and the device-side wire is connected with the connector. Thus, the device-side wire and the branch line are shorted by the busbar. The connector having the busbar provided therein may be prepared first and the branch line drawn out from the main line is connected with the connector. The branch line subsequently is branch-connected with the device-side wire via the busbar by connecting the device-side wire with the connector. Therefore, even if the main line is equipped with no connector beforehand, a device can be attached later if necessary.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
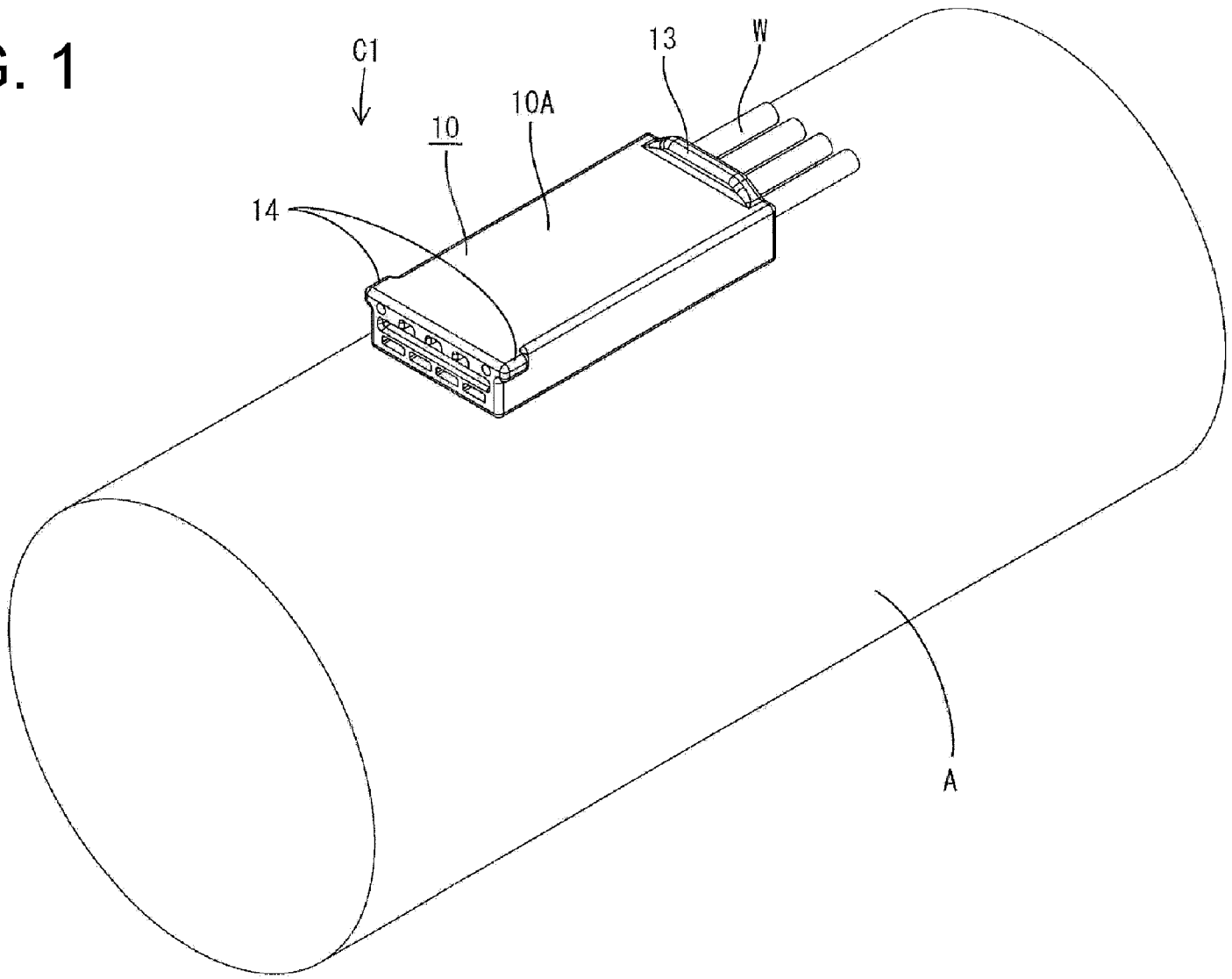
FIG. 1 is a perspective view showing a used state of a connector according to a first embodiment.
Figure 2:
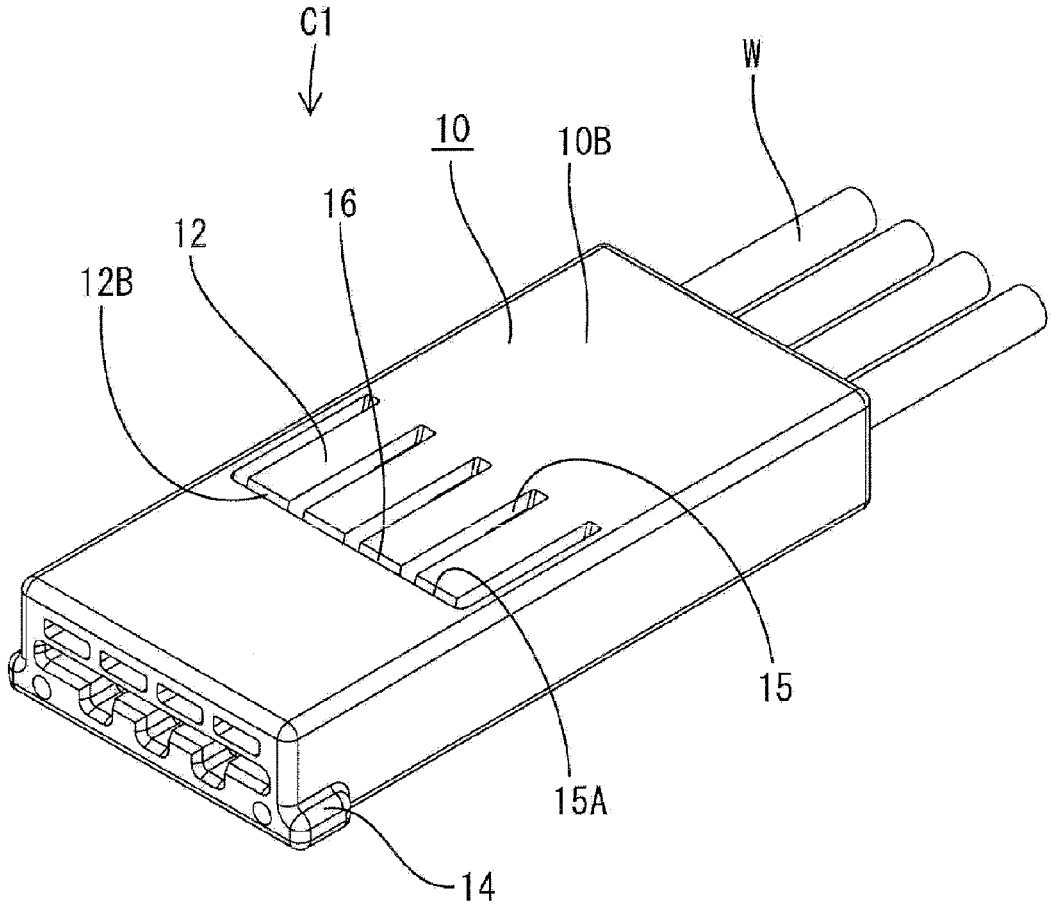
FIG. 2 is a perspective view of the connector.
Figure 3:
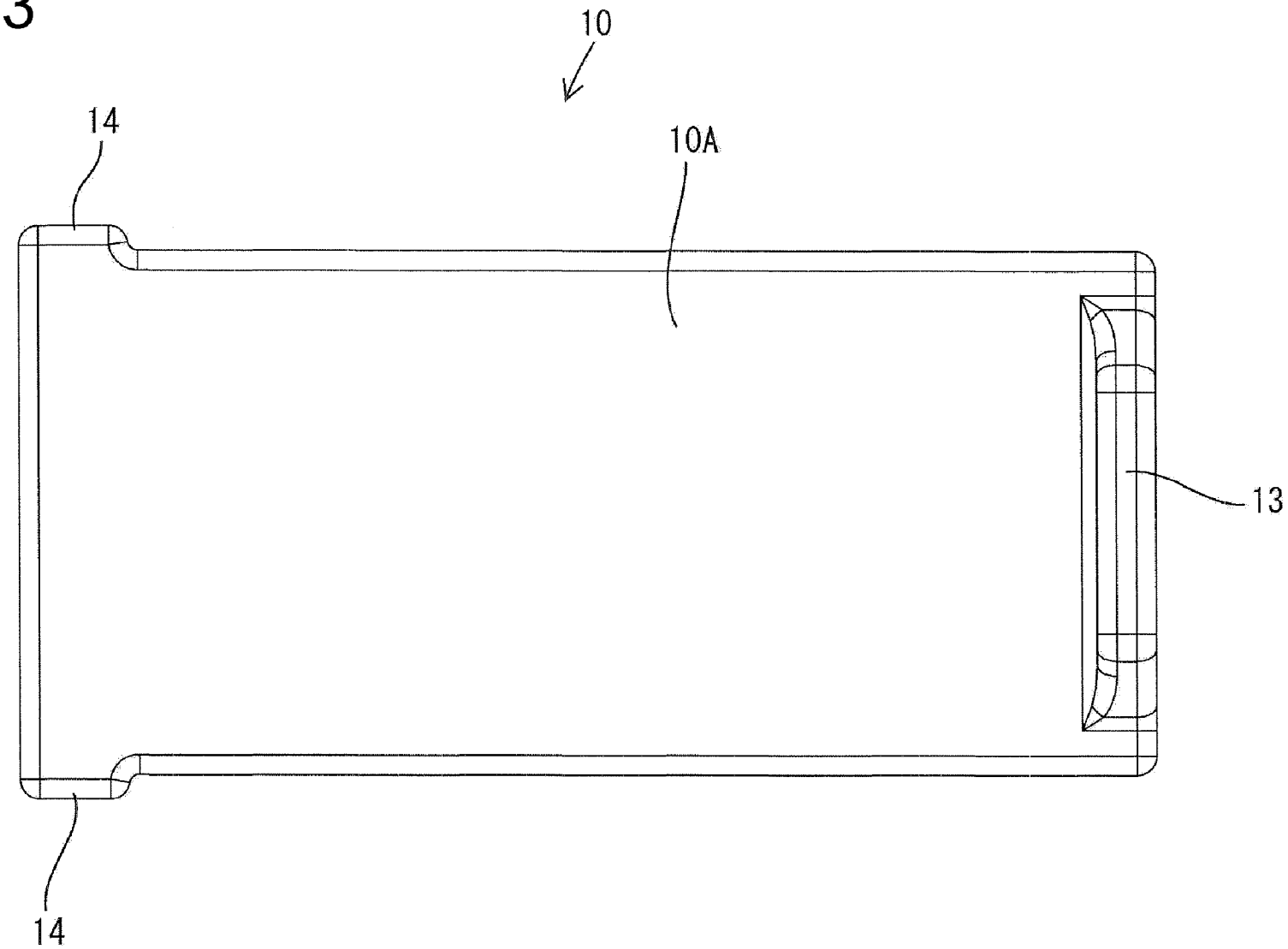
FIG. 3 is a top view of a housing.
Figure 4:
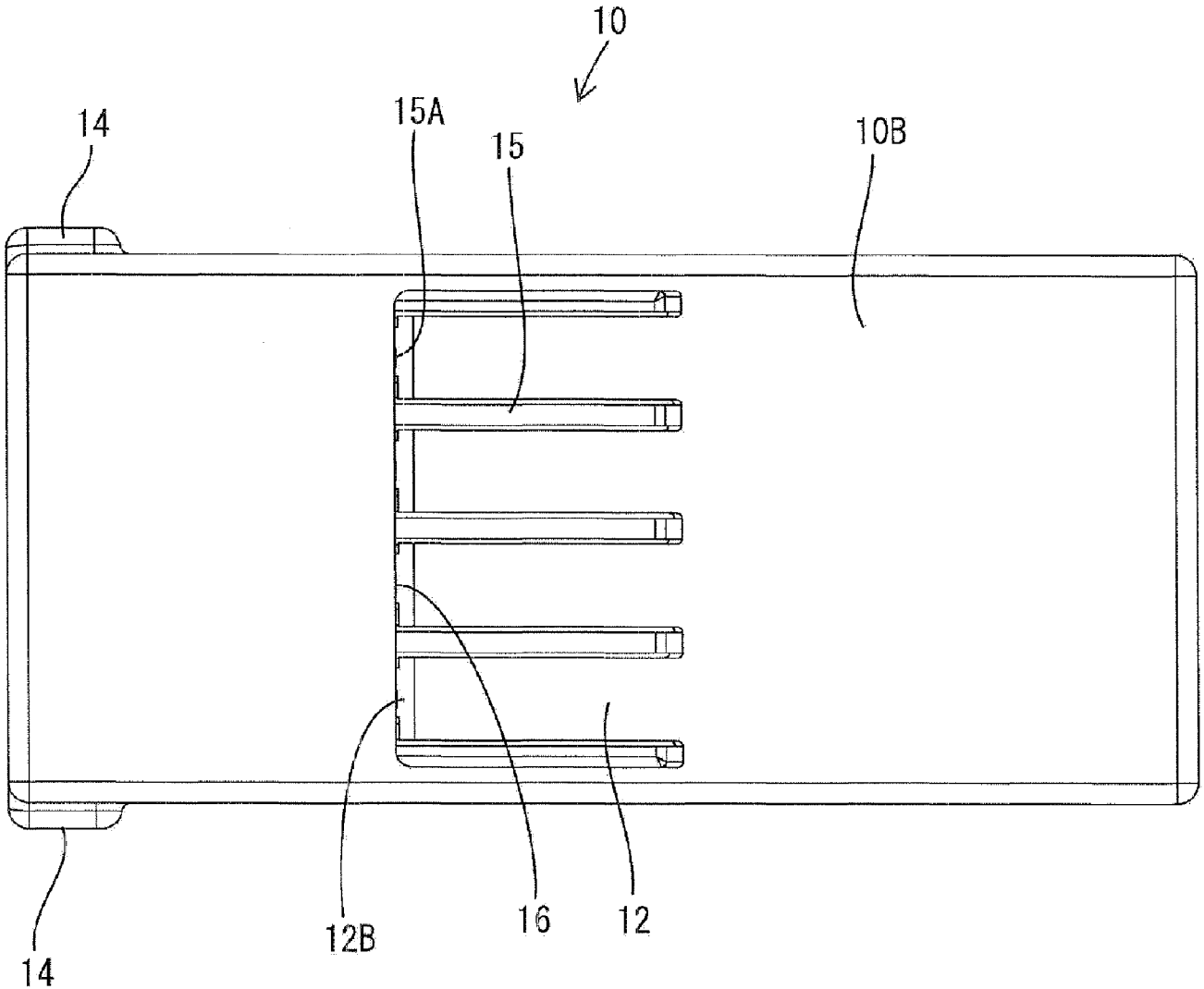
FIG. 4 is a bottom view of the housing.
Figure 5:
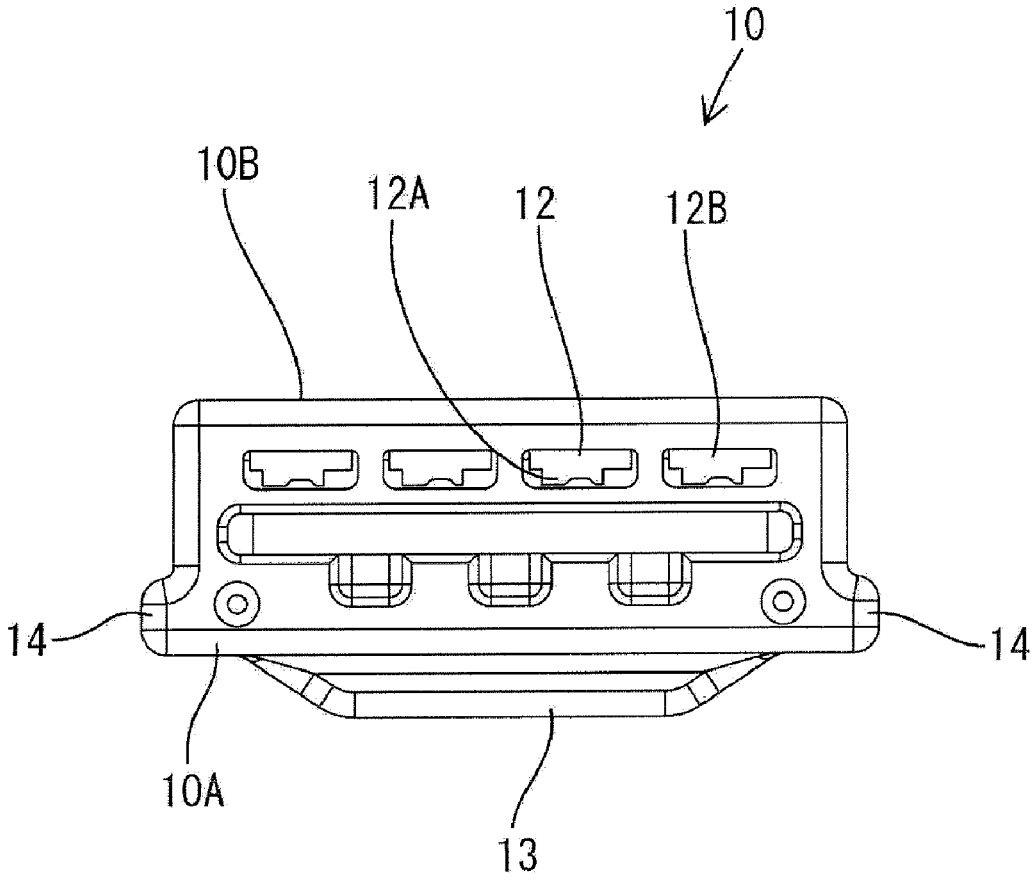
FIG. 5 is a front view of the housing.

A connector in accordance with a first embodiment of the invention is identified as C1 in FIGS. 1 to 12. The connector C1 is a joint connector and has a housing 10 internally formed with cavities 11 capable of accommodating terminals 20. The housing has locking lances 12 for engaging the respective terminals 20 that have been inserted properly into the cavities 11 and retaining the terminals 20 in the cavities 11. The connector C1 also has at least one busbar 30 for shorting the terminals 20 in the cavities 11. The connector C1 is fixed to a main line A of a wiring harness by tape (not shown). A side of the connector C1 to be connected with a mating connector is referred to as the front and left-lower, right-upper, upper and lower sides of FIG. 1 are referred to as front, rear, top and lower sides in the respective constituent elements.

The housing 10 is made e.g. of synthetic resin and has a substantially flat box shape. A rib 13 is provided on a top wall 10A of the housing 10, which is on a side opposite to a side in contact with the main line A of the wiring harness. The rib 13 projects out and up from the top wall 10A and extends substantially along the rear end of the housing 10 over substantially the entire width of the housing 10 in a short side direction (see FIG. 3).

Protrusions 14 project laterally from the front end of the top wall 10A of the housing 10. The ribs 13 and protrusions 14 prevent the tape fastening the connector C1 to the main line A of the wiring harness from being displaced forward or backward of the housing 10 and loosened. Thus, the connector C is fixed firmly to the main line A of the wiring harness.

Cavities 11 are formed substantially side by side in a width direction in the housing 10 and are long and narrow in forward and backward directions. The cavities 11 have substantially rectangular cross section larger than connecting portions 22 of the terminals 20 to be described later. The terminals 20 are inserted into the respective cavities 11 from behind.

An opening 15 is formed in the lower wall 10B of the housing 10 (see FIG. 4) for exposing the cavities 11 to the lower side of the housing 10. The opening 15 is formed in the middle of the housing 10 in forward and backward directions and has a substantially rectangular shape long in the width direction of the housing 10.

The locking lances 12 are formed at the lower wall 10B of the housing 10 and are cantilevered forward from the rear edge of the opening 15 of the housing 10. Thus, the opening 15 is mostly covered by the locking lances 12. The locking lances 12 are of substantially the same shape and size and are arranged substantially side by side in the width direction in conformity with the positions of the respective cavities 11.

Figure 7:
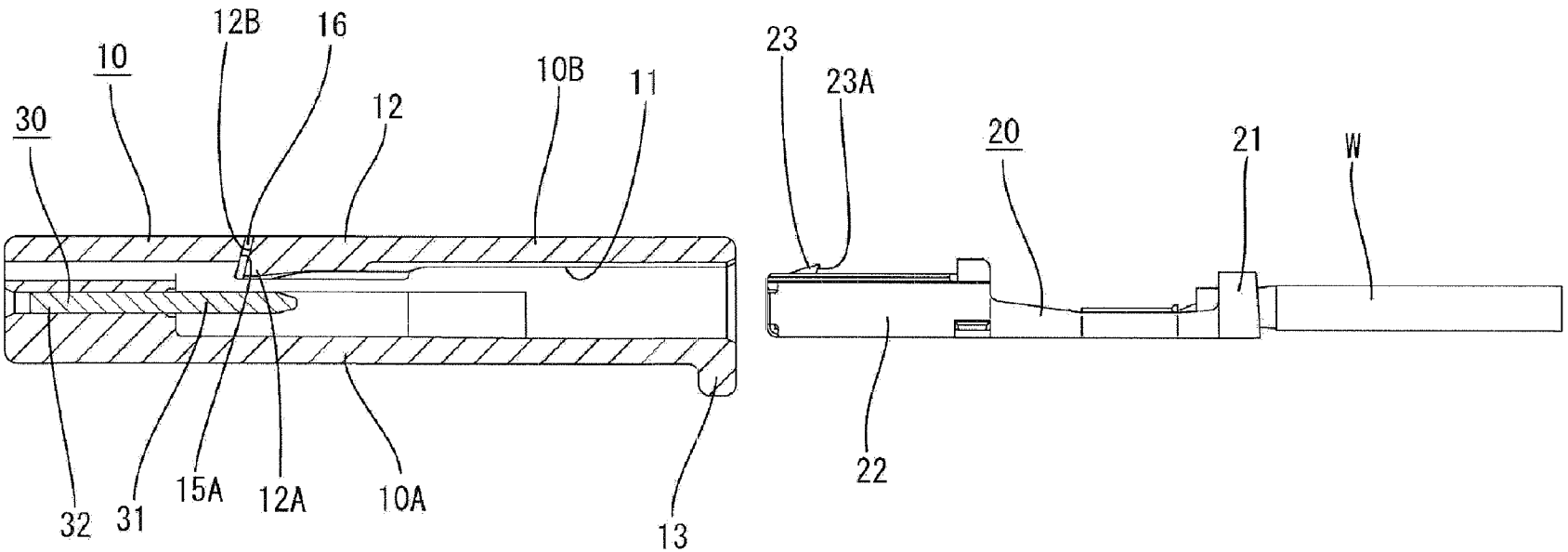
FIG. 7 is a side view in section showing a state before a terminal is inserted into the housing.

As shown in FIG. 7, an engaging portion 12A is formed at the free front end of each locking lance 12 and projects into the cavity 11 for engaging an engageable portion 23 of the terminal 20 and to prevent the terminal 20 from being withdrawn backward. An inner part of a front end surface 12B of the locking lance 12 forms the front end surface of the engaging portion 12A.

Each locking lance 12 is resiliently deformable in inward and outward directions of the housing 10 in a direction intersecting an inserting direction of the terminal 20. The engaging portion 12A moves onto the engageable portion 23 of the terminal 20 when the terminal 20 is inserted into the cavity 11 and the locking lance 12 is deformed resiliently out toward the lower side to permit insertion of the terminal 20. The position of the locking lance 12 at this time corresponds to a disengaging position. The locking lance 12 returns toward a natural state and engages the terminal 20 when the terminal 20 is inserted to a proper position where connection with the busbar 30 is secure The position of the locking lance 12 at this time corresponds to an engaging portion.

The locking lance 12 at the engaging position is arranged so as not to project out from the housing 10 at all, and the lower surfaces of the locking lance 12 and the housing 10 are substantially flat (see FIG. 7). A front end of the locking lance 12 projects out from the housing 10 when the locking lance 12 is deformed resiliently out from the engaging position even to a small degree. Thus, the engaging portion 12A is left on the engageable portion 23 if the terminal 20 is inserted insufficiently and the locking lance 12 projects from the lower wall 10B of the housing 10 by that much.

Figure 11:
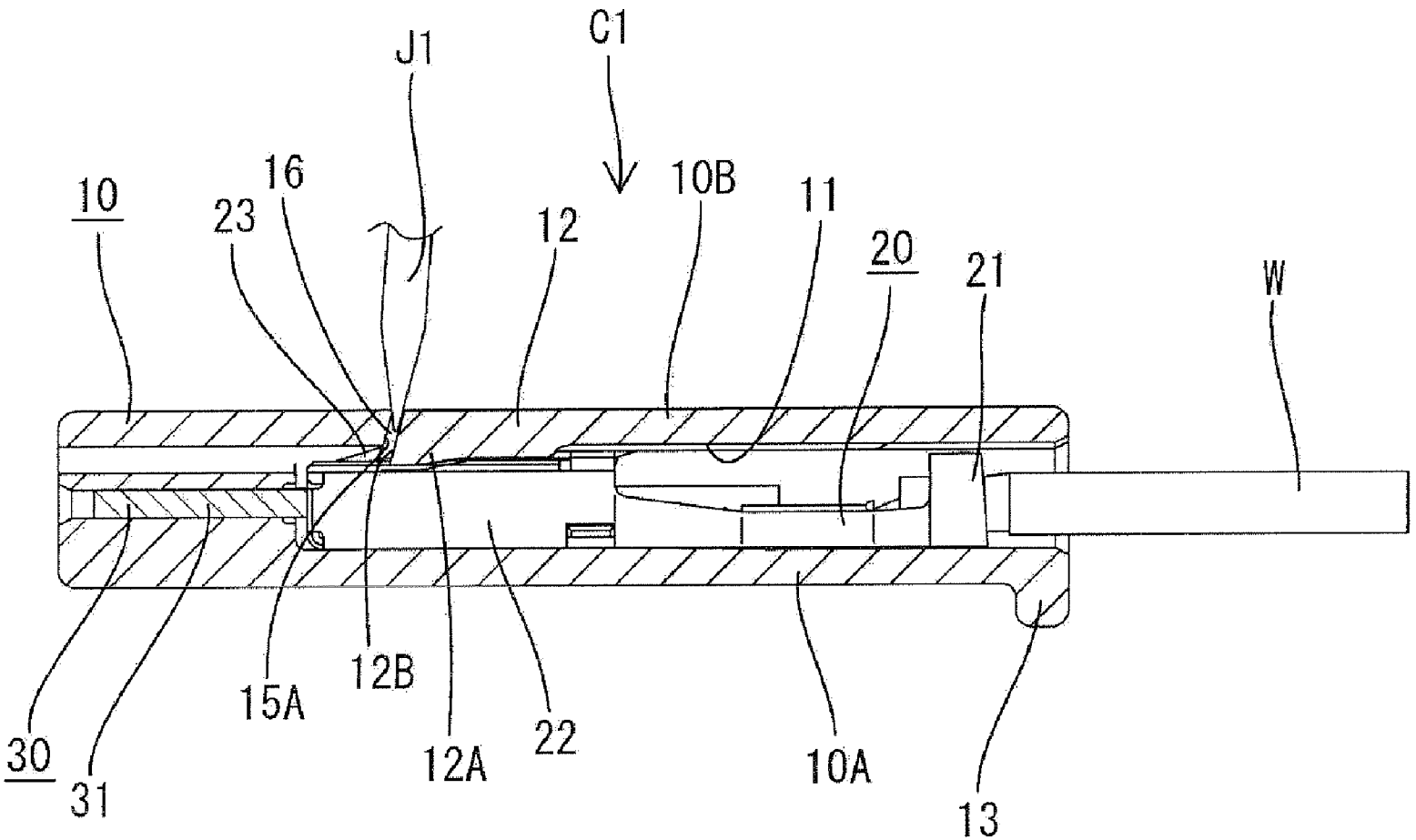
FIG. 11 is a side view in section showing a state where a disengaging jig is inserted in a jig hole.

A jig insertion hole 16 is formed between the front end surface 12B of the locking lance 12 and the opening 15 and can receive a disengaging jig J1 (see FIG. 11). The leading end of the disengaging jig J1 is inserted into the jig hole 16 and is brought into engagement with the front end surface 12B of the locking lance 12 to resiliently deform the locking lance 12 to the disengaging position.

Each terminal 20 is made of an electrically conductive metal plate material. A wire connection barrel 21 is formed at the rear end of the terminal 20 and can be crimped, bent or folded into connection with an end portion of a wire W. A rectangular tubular connecting portion 22 is formed at the front end of the terminal 20 and has open front and rear ends. A terminal portion 31 of the busbar 30 mounted into the housing 10 is inserted into the connecting portion 22 from the front for electrically connecting the busbar 30 and the terminal 20.

The connecting portion 22 of the terminal 20 includes the engageable portion 23 that is engageable with the engaging portion 12A of the locking lance 12. The engageable portion 23 is located at a position in the front half of the connecting portion 22 and projects out from the connecting portion 22. The rear surface of the engageable portion 23 is inclined to project gradually back toward the projecting end, and the front surface of the engaging portion 12A is engaged with this surface from behind.

Figure 6:
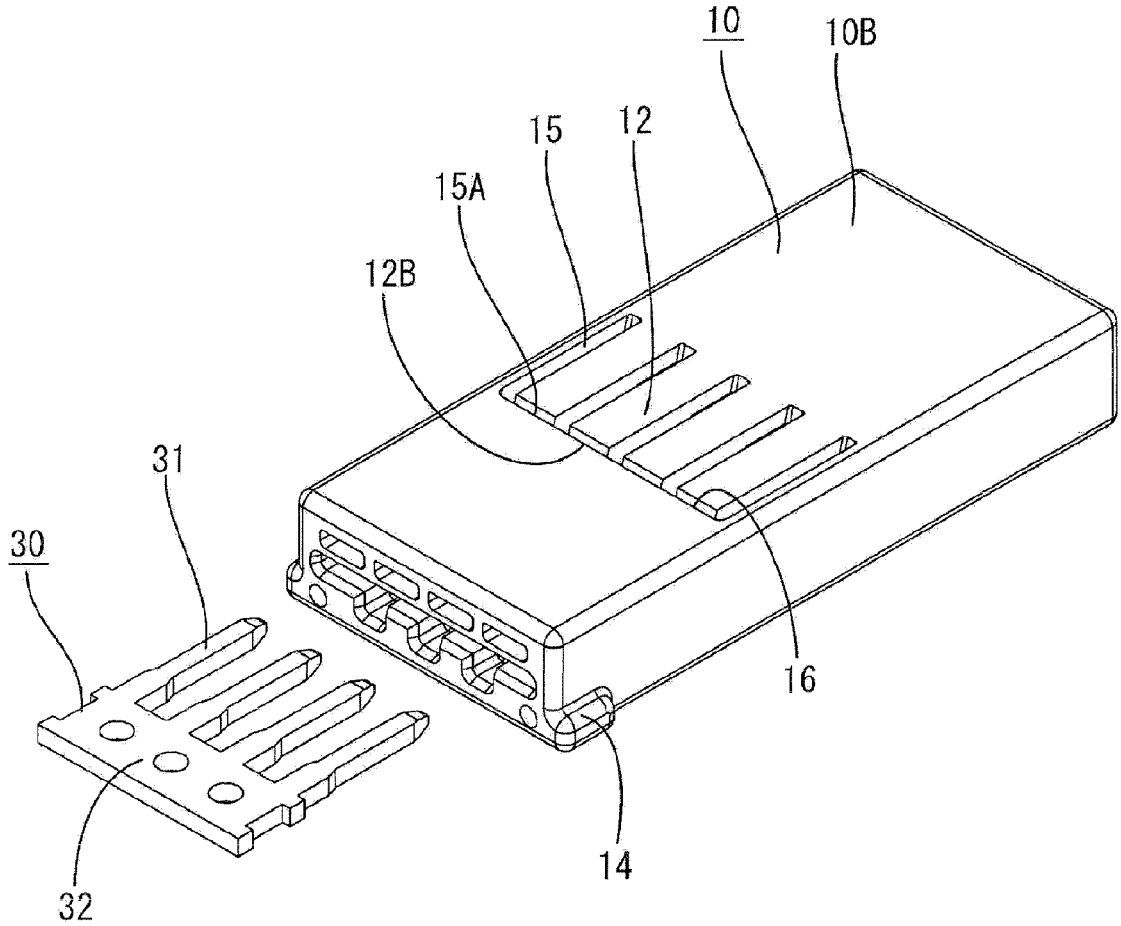
FIG. 6 is a perspective view showing a state before a busbar is mounted into a housing.

The busbar 30 is formed of an electrically conductive metal material to have a substantially flat shape, and includes tab-shaped terminal portions 31 (see FIG. 6). The terminal portions 31 are connected by a connecting portion 32 and substantially parallel to each other at substantially the same intervals as the arrangement intervals of the cavities 11. The busbar 30 is mounted into the housing 10 by pressing the terminal portions 31 into the corresponding cavities 11 from the front. The respective terminal portions 31 project into the corresponding cavities 11 and connect with the connecting portions 22 of the respective terminals 20 accommodated in the cavities 11.

The front end surface 12B of the locking lance 12 is inclined to project gradually forward toward an inner side of the housing 10 at an angle that substantially equals the inclination of the rear surface of the engageable portion 23 of the terminal 20.

A facing surface 15A is formed at the front of the opening 15 in the lower wall 10B and faces the front end surfaces 12B of the locking lances 12. The facing surface 15A is inclined to project gradually back toward the locking lances 12 and toward an outer side of the housing 10. The inclination of the facing surface 15A is substantially equal to the inclination of the front end surfaces 12B of the locking lances 12 so that the front end surfaces 12B of the locking lances 12 and the facing surface 15A of the housing 10 are substantially parallel when the locking lances 12 are at the engaging positions.

The inclinations of the front end surface 12B of each locking lance 12 and the facing surface 15A of the housing 10 and the spacing between the front end surface 12B and the facing surface 15A are set so that the front end surface 12B and the facing surface 15A do not touch when the locking lances 12 deform in a range up to the disengaging position, but touching each other when the locking lance 12 is deformed out beyond the disengaging position.

The jig holes 16 obliquely extend because the front end surfaces 12B of the locking lances 12 and the facing surface 15A of the housing 10 are inclined. The jig holes 16 obliquely penetrate the lower wall 10B of the housing 10 toward an upper rear side from the cavities 11.

Figure 8:
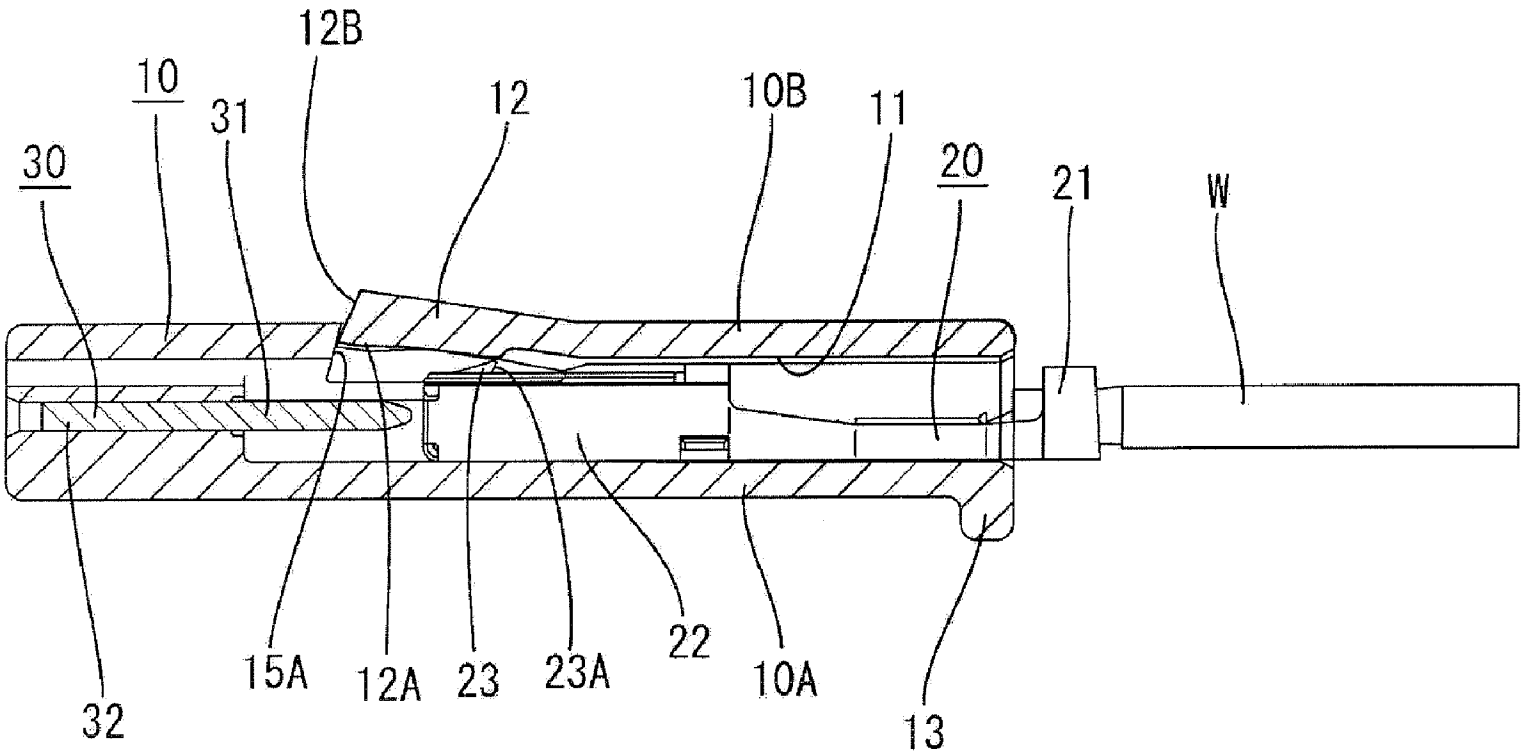
FIG. 8 is a side view in section showing a state where the terminal is inserted in the housing.

The engageable portion 23 of the terminal 20 moves onto the engaging portion 12A of the locking lance 12 when the terminal 20 is inserted into the cavity 11 and deforms the locking lance 12 out as shown in FIG. 8. The locking lance 12 then reaches the disengaging position and the terminal 20 moves forward in the cavity 11. At this time, the front end surface 12B of the locking lance 12 does not contact the facing surface 15A of the housing 10. As a result, the terminal 20 can be inserted smoothly.

Figure 9:
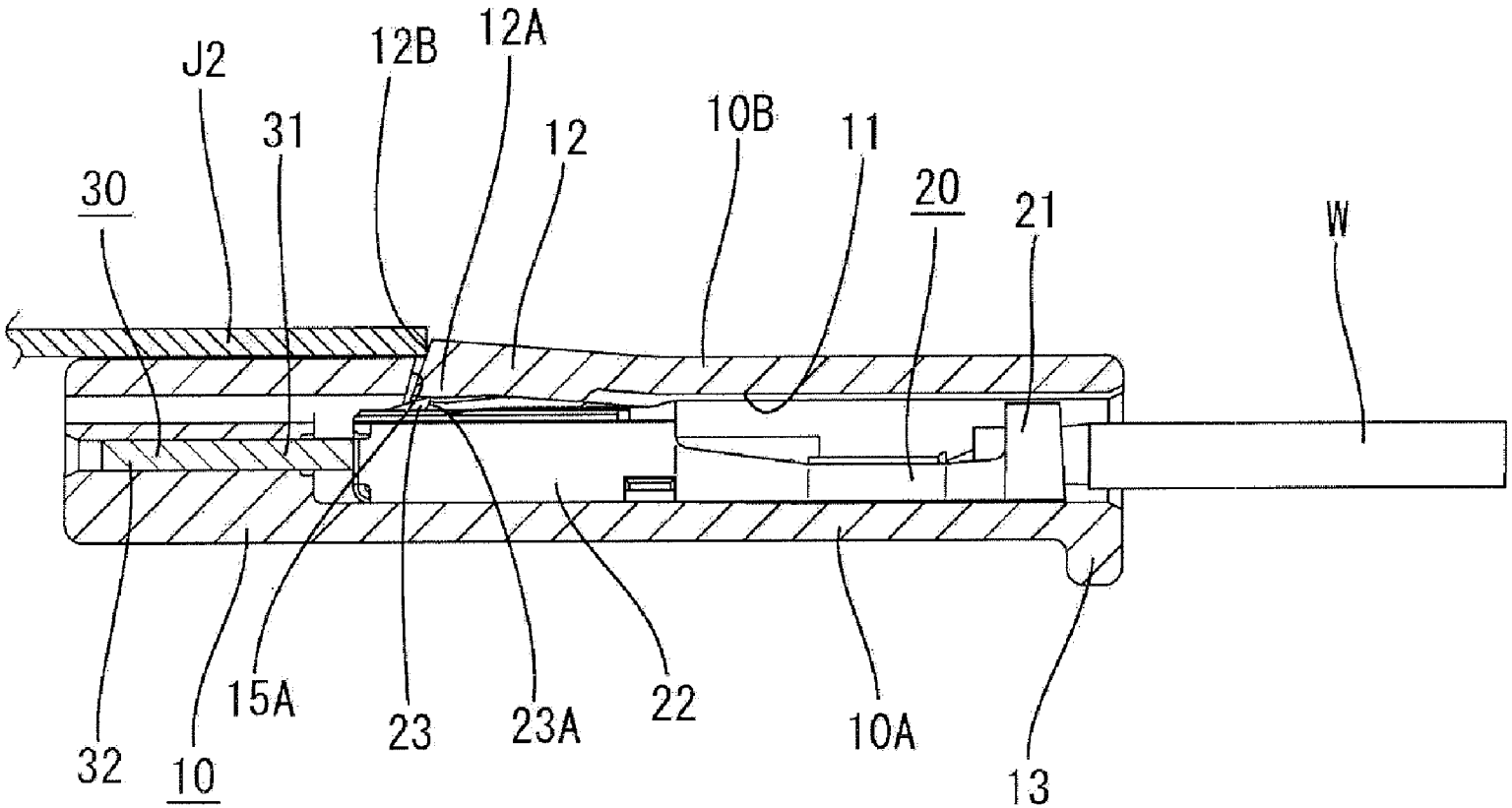
FIG. 9 is a side view in section showing a state where the insufficient insertion of the terminal is detected.
Figure 10:
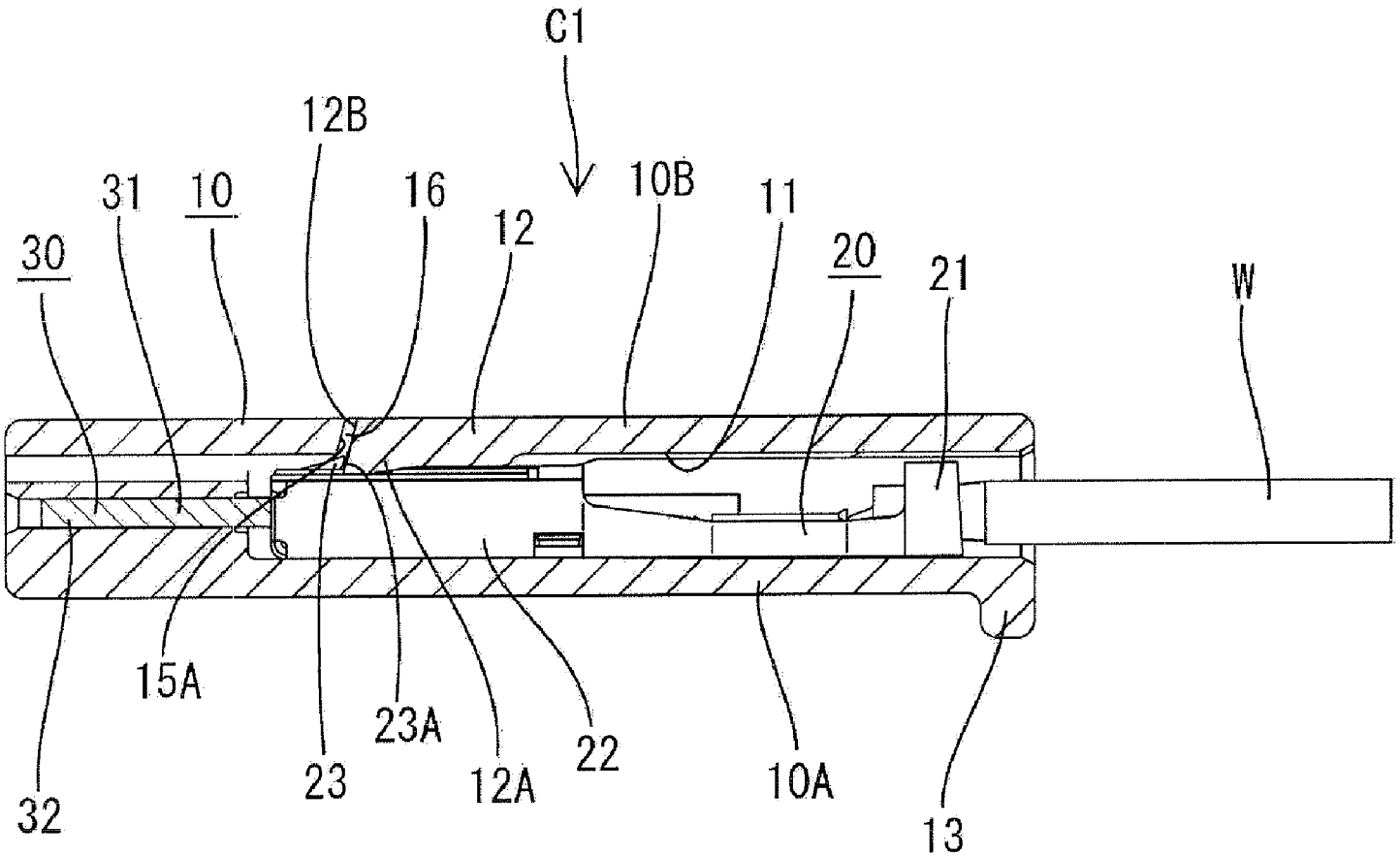
FIG. 10 is a side view in section showing a state where the terminal is accommodated at a proper position.

A detecting jig J2 can be slid back from the front along the lower wall 10B of the housing 10 after the terminals 20 have been inserted (see FIG. 9). The front end of the locking lance 12 projects out from the housing 10 if the terminal 20 is inserted insufficiently and will hinder the sliding movement of the detecting jig J2. On the other hand, the locking lances 12 are at the engaging positions when the terminals 20 are at the proper positions of the cavities 11 and do not project out from the housing 10, as shown in FIG. 10. Thus, the detecting jig J2 can be slid back along the lower surface of the housing 10 without touching any locking lance 12. Therefore, the insufficient insertion of the terminals 20 can be detected by sliding the detecting jig J2.

Figure 12:
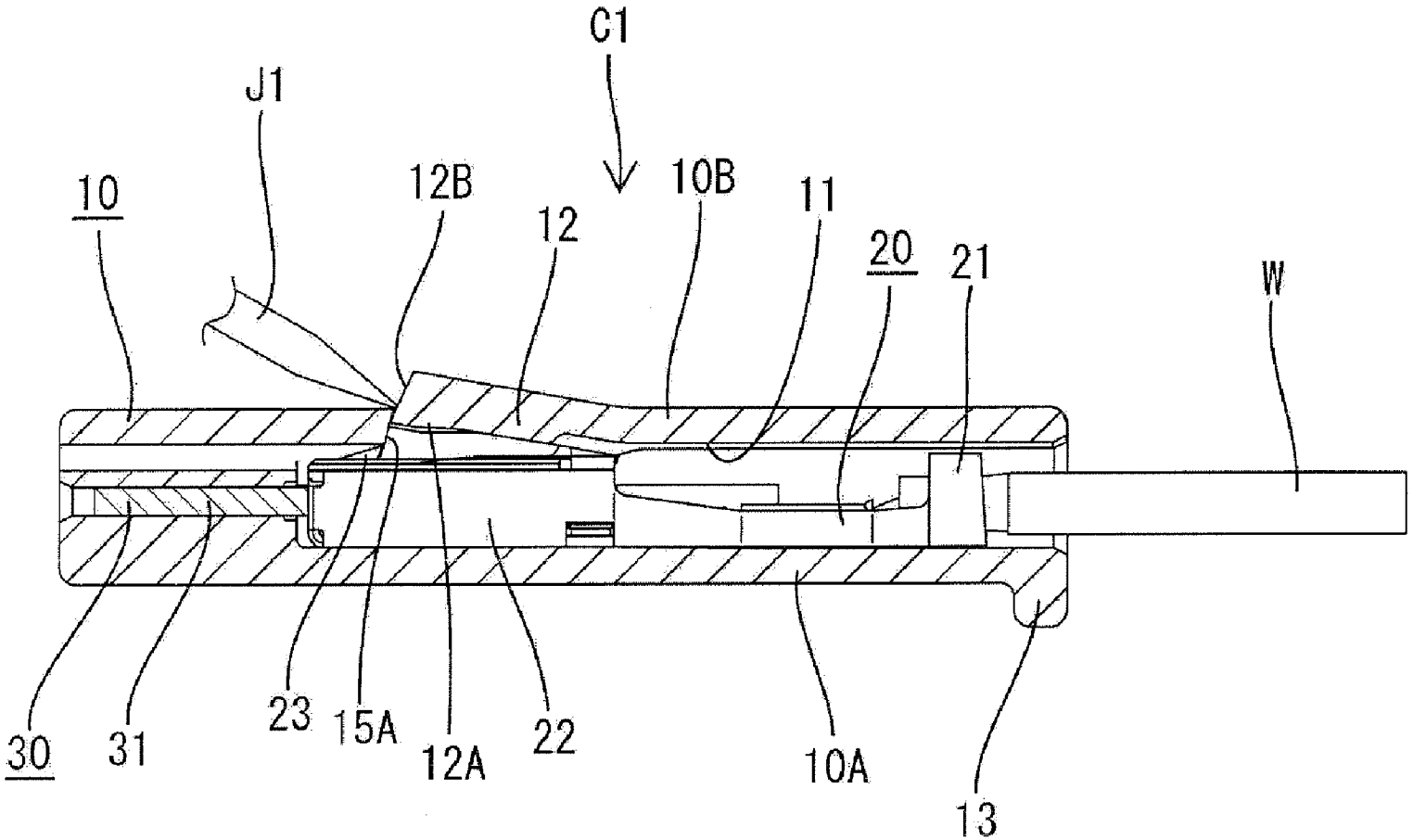
FIG. 12 is a side view in section showing a state where a locking lance is resiliently deformed outward by the disengaging jig.
Figure 13:
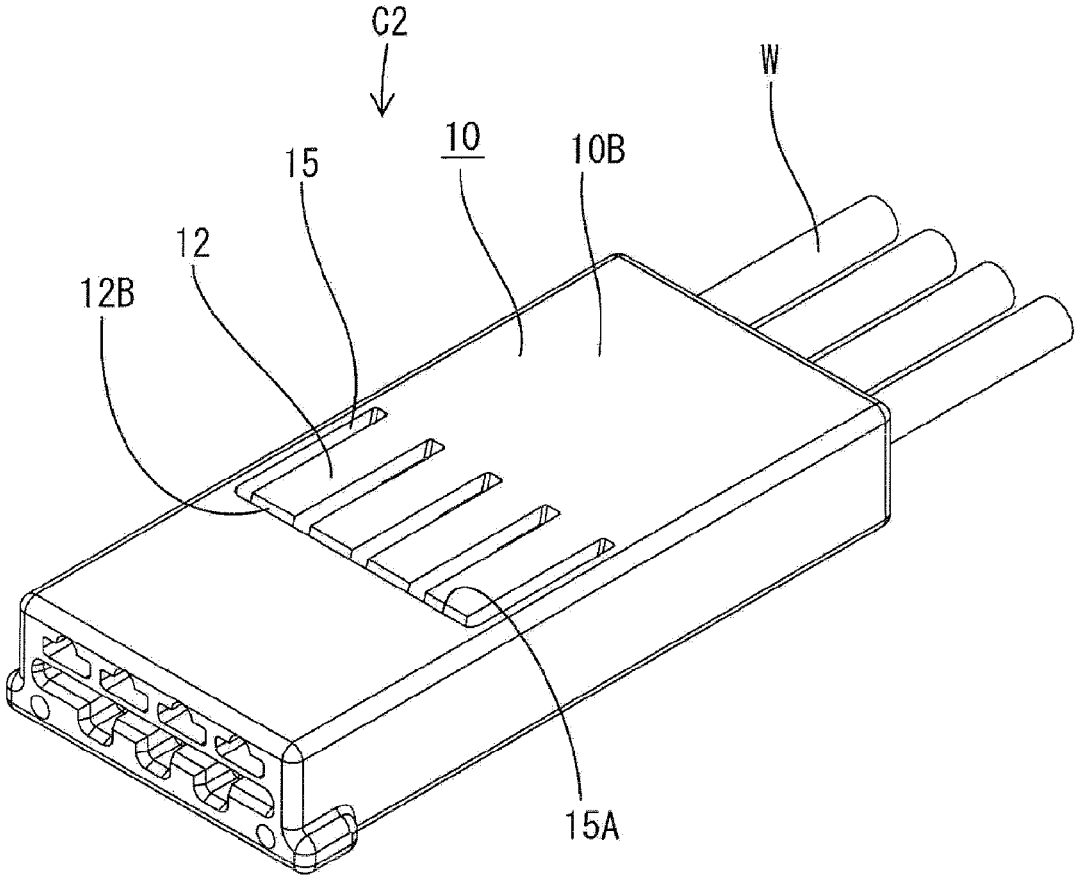
FIG. 13 is a perspective view of a connector according to a second embodiment.
Figure 14:
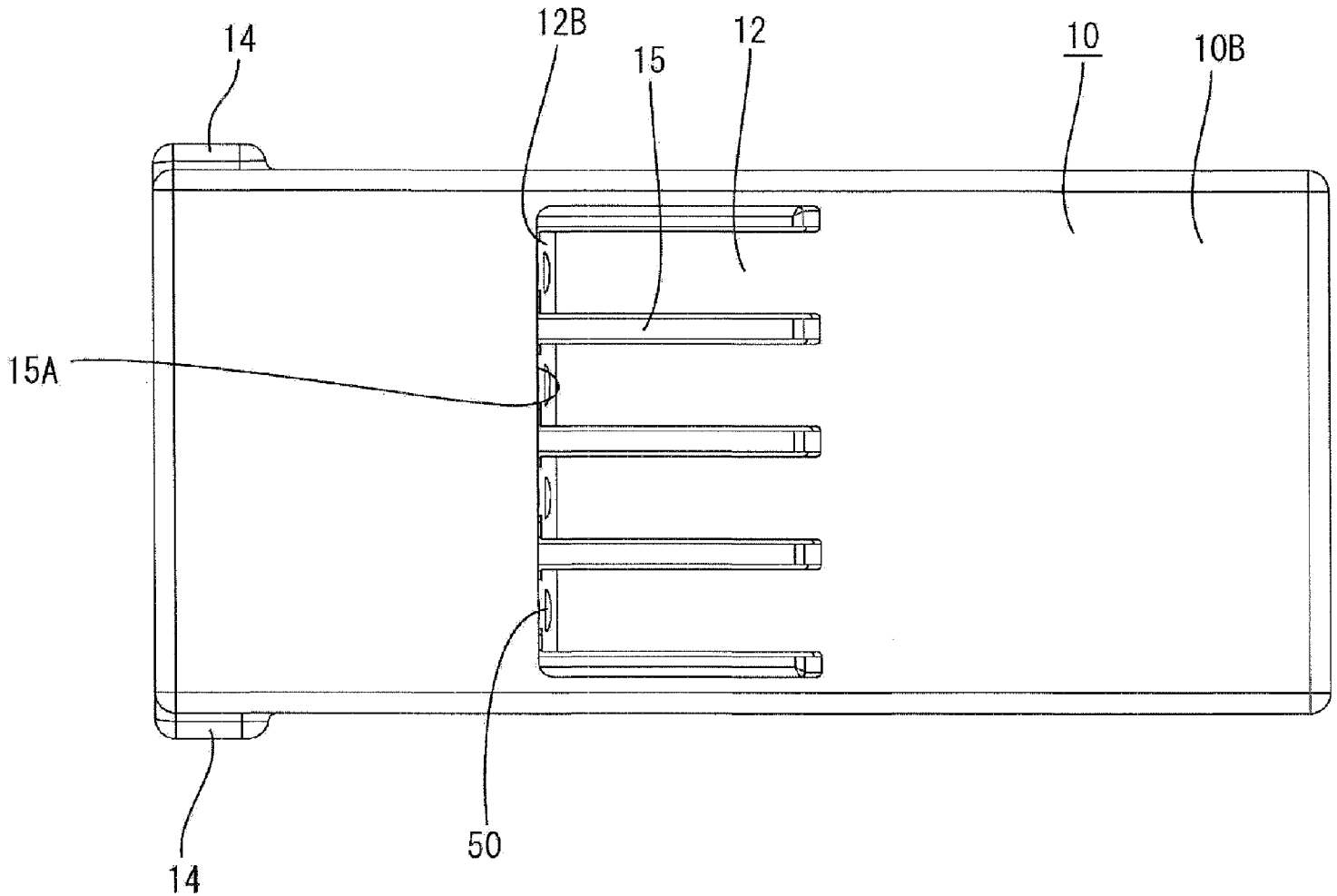
FIG. 14 is a bottom view of a housing.

The disengaging jig J1 is used to withdraw the terminal 20 from the cavity 11. More particularly, the leading end of the disengaging jig J1 is inserted into the jig hole 16 to engage the front end surface 12B of the locking lance 12 and to lift the locking lance 12 out, as shown in FIGS. 11 and 12. The innermost end edge of the front end surface 12B of the locking lance 12 contacts a substantially central position of the facing surface 15A of the housing 10 in inward and outward directions to prevent displacement of the locking lance 12 beyond the disengaging position. Accordingly, the locking lance 12 cannot be deformed excessively.

The jig holes 16 of the housing 10 are formed by removing mold pieces (not shown) obliquely toward an upper rear side upon forming the housing 10. If the jig holes 16 were formed in a direction substantially orthogonal to forward and backward directions of the housing 10 instead of being formed obliquely, the spacing between the front end surfaces of the locking lances and the facing surface would need to be very narrow for the front end surface of the locking lance to contact the facing surface when the locking lance is deformed out beyond the disengaging position. However, there is a limit in thinning the mold pieces to ensure specified mold strength, and it is difficult to have a very narrow the spacing between the front end surfaces of the locking lances and the facing surface of the housing. However, the front end surfaces 12B of the locking lances 12 and the facing surface 15A of the housing 10 are inclined to enable the above-described effect without extremely narrowing the spacing between the front end surfaces 12B of the locking lances 12 and the facing surface 15A.

As described above, the front end surfaces 12B of the locking lances 12 are inclined to project gradually forward toward the inner side of the housing 10 and the facing surface 15A of the housing 10 is inclined to project gradually out toward the locking lances 12. Thus, the front end surfaces 12B of the locking lances 12 contact the facing surface 15A if the locking lances 12 are deformed outward beyond the disengaging positions. Thus, the locking lances 12 cannot deform out beyond the disengaging positions and excessive deformation of the locking lances 12 is prevented.

A connector according to a second embodiment of the invention is identified as C2 to FIGS. 13 to 17. The connector C2 differs from the first embodiment in that catches 50 are provided at the front end surfaces 12B of the locking lances 12 for engaging the disengaging jig J1. Elements similar to the first embodiment are identified by the same reference numerals and not described again.

The connector C2 has a housing 10 internally formed with cavities 11 for accommodating terminals 20 and locking lances 12 for engaging and retaining the terminals 20 that have been inserted into the cavities 11. Similar to the first embodiment, the locking lances 12 are formed at a lower wall 10B of the housing 10 and resiliently deformable inward and outward between engaging positions for engaging the terminals 20 and disengaging positions to permit the insertion and withdrawal of the terminals 20. Further, similar to the first embodiment, the leading end of the disengaging jig J1 can be brought into engagement with a front end surface 12B of the locking lance 12 to deform the locking lance 12 to the disengaging position for withdrawing the terminal 20 from the cavity 11.

Figure 15:
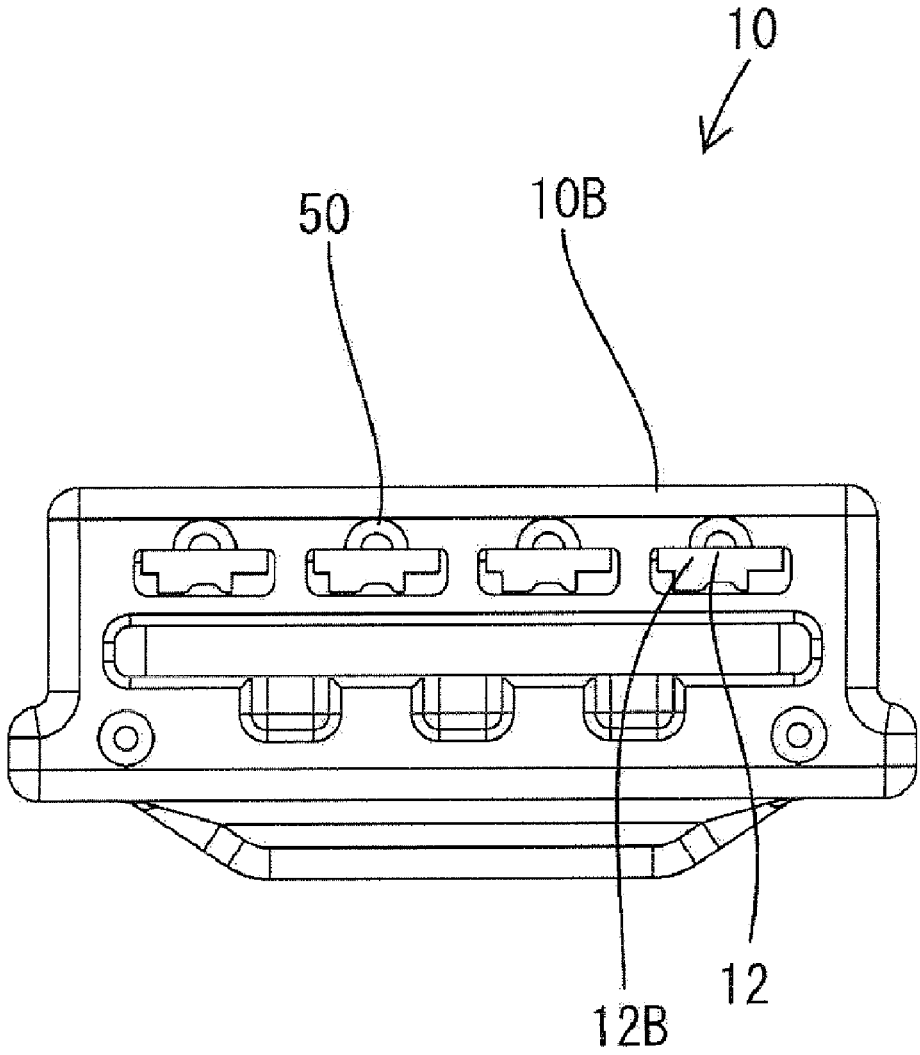
FIG. 15 is a front view of the housing.
Figure 16:
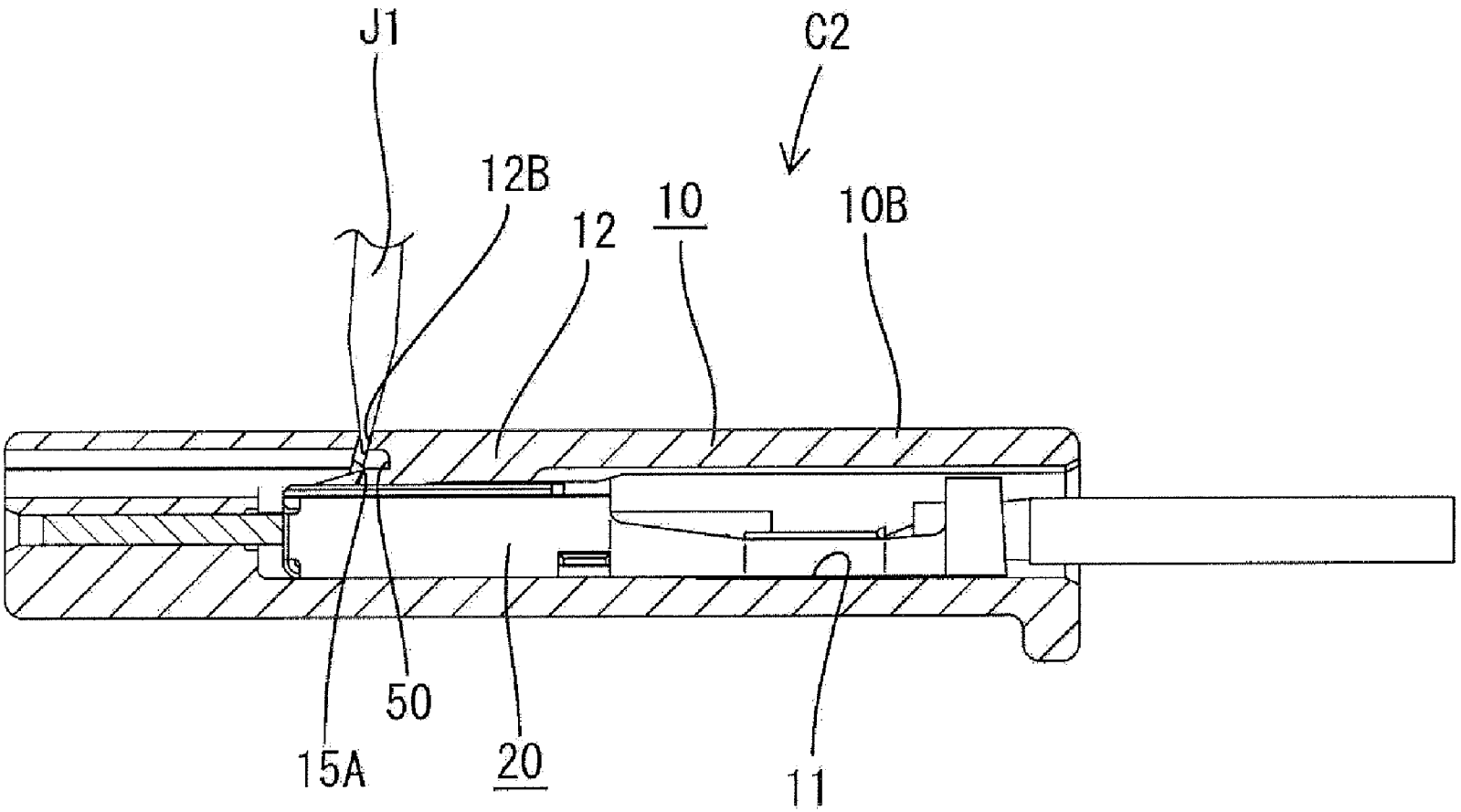
FIG. 16 is a side view in section showing a state where a disengaging jig is inserted in a jig hole.
Figure 17:
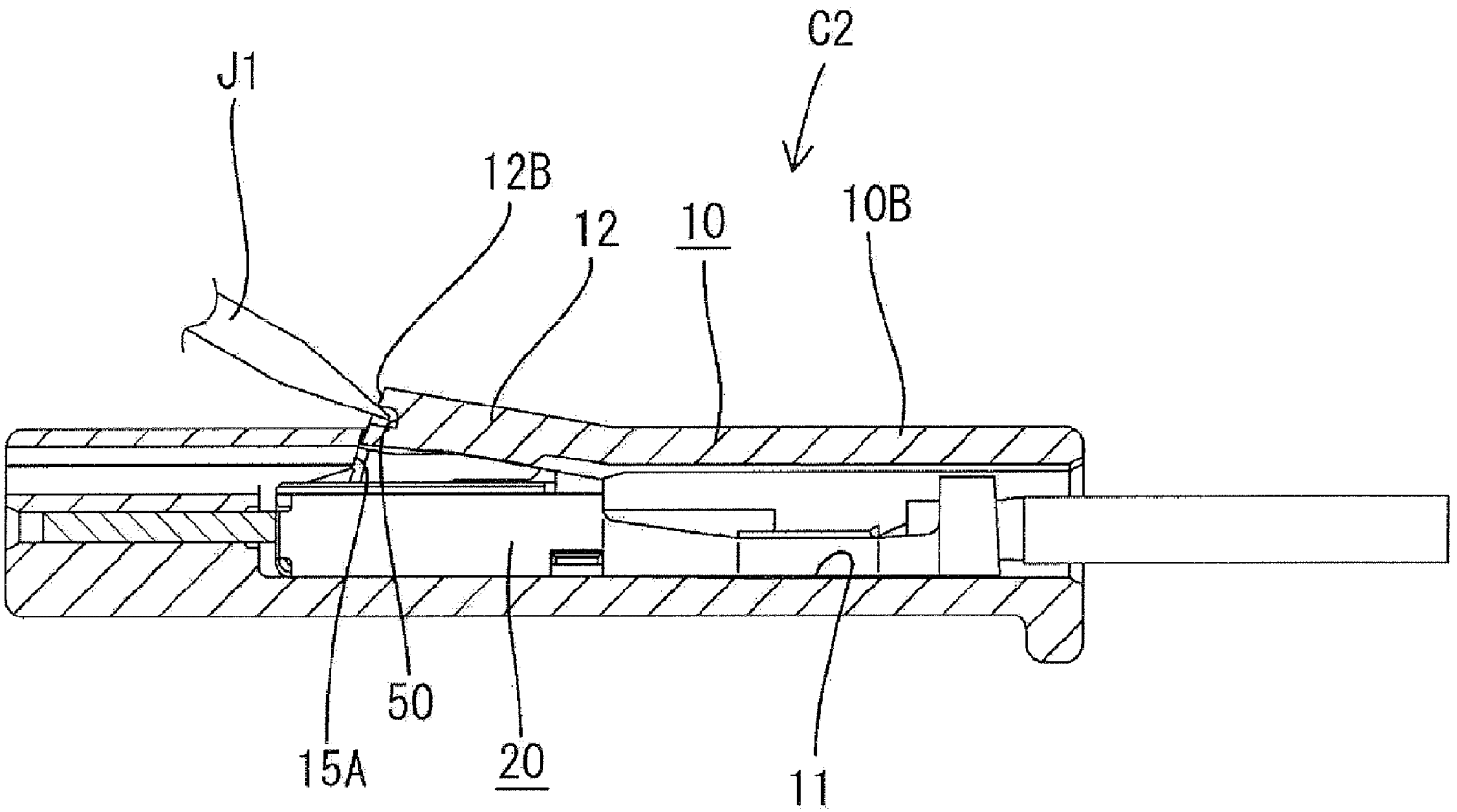
FIG. 17 is a side view in section showing a state where a locking lance is resiliently deformed outward by the disengaging jig.

The catches 50 are provided respectively at the front end surfaces 12B of the locking lances 12. Each catch 50 is a recess formed in the front end surface 12B and a recessing direction thereof is substantially parallel to the lower wall 10B of the housing 10 when the locking lance 12 is at the engaging position (see FIG. 16). The catch 50 is at a substantially widthwise central part of the locking lance 12 and has a substantially arcuate shape, as shown in FIG. 15 when viewed from front. A tip thereof at the outermost side is substantially in the center of the locking lance 12 in inward and outward directions, i.e. located above a part of the front end surface 12B of the locking lance 12 to engaged a rear surface 23A of an engageable portion 23 of the terminal 20.

The front end surfaces 12B of the locking lances 12 are inclined to project gradually forward toward an inner side of the housing 10. A facing surface 15A of the housing 10 is inclined to project gradually out toward the locking lances 12 and the front end surfaces 12B of the locking lances 12 contact the facing surface 15A if the locking lances 12 are deformed outward beyond the disengaging positions to prevent excessive deformations of the locking lances 12.

The catches 50 of this embodiment are formed at the front end surfaces 12B of the locking lances 12 for engaging the disengaging jig J1. Thus, the locking lances 12 can be deformed resiliently by engaging the disengaging jig J1 with the catch 50. Thus, the disengaging jig J1 cannot slide on the front end surfaces 12B of the locking lances 12 and the locking lances 12 can be disengaged easily.

Each catch 50 is in the widthwise center of the locking lance 12. Thus, the force of the disengaging jig J1 for deforming the locking lance 12 acts on the locking lance 12 in a well-balanced manner and the locking lance 12 can be disengaged more easily.

A third embodiment of the invention is described with reference to FIGS. 18 and 19. In this embodiment, a main line A1 is formed by bundling one or more power wires and/or one or more signal wires, and one or more branch lines B, such as signal wires, branched from the main line A1 are branch-connected with a device (not shown). Elements of the third embodiment that are the same as or similar to the first embodiment are identified by the same reference numerals, but are not described again. The main line A1 preferably is made up of aluminum wires, each of which has a core formed by twisting strands made of aluminum or aluminum alloy and covered by an insulation coating made e.g. of synthetic resin.

The branch connection may be with a device-side wire W1 that is to be connected electrically with an external electric or electronic device (such as a junction box, a load, a sensor or the like). A nonconductive film, such as an oxide film, is likely to be formed on the outer surface of the aluminum wire. The film on the outer surface typically cannot be scraped off sufficiently merely by pressing the wire between contact blades of an insulation displacement terminal and problems, such as a connection error and an increase of contact resistance, are likely to occur (see, for example, Japanese Unexamined Patent Publication No. 2007-87861). Thus, a crimping connection is preferred for an aluminum wire. For the above reason, a connector C1 of the third embodiment has a cavity 11 and a terminal 20 that is crimped, bent or folded into connection with an end portion of the branch line B is inserted into the cavity 11.

Figure 18:
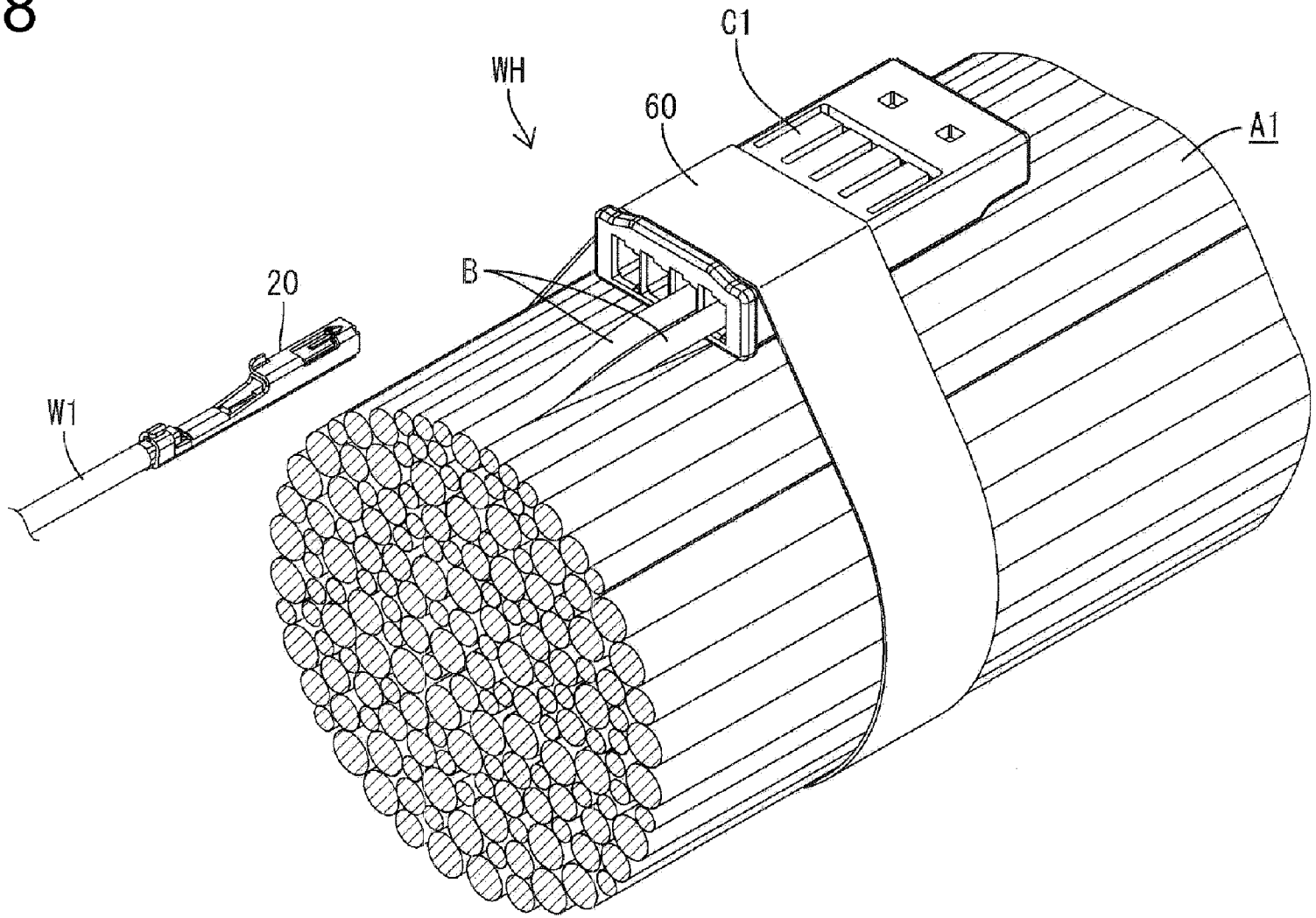
FIG. 18 is a perspective view of a wiring harness showing a state before a device-side wire is connected with a connector in a third embodiment.
Figure 19:
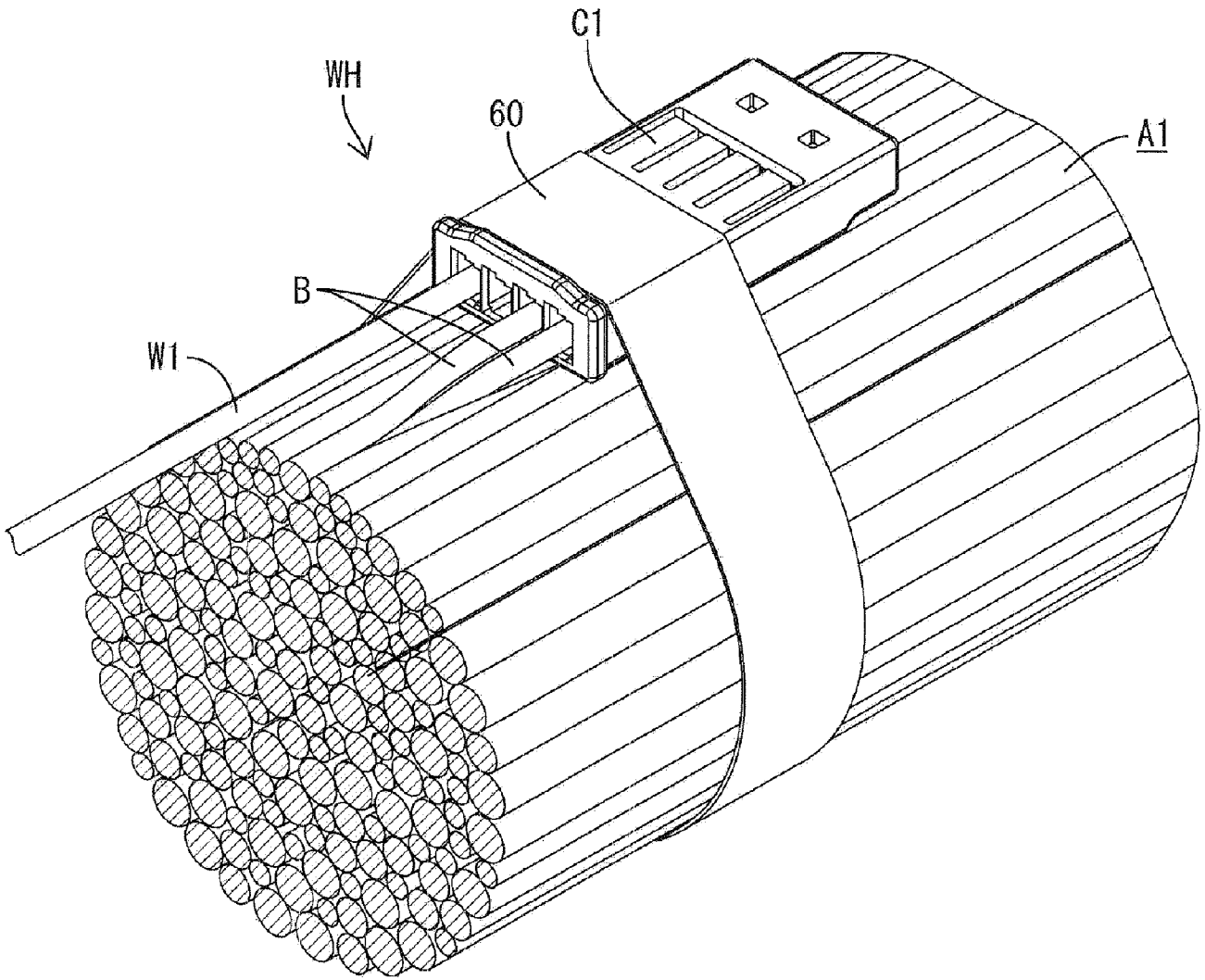
FIG. 19 is a perspective view of the wiring harness showing a state where the device-side wire is connected with the connector.

As shown in FIG. 18, the wiring harness WH includes the main line A1 and the connector C1 mounted on the outer circumferential surface of the main line A1. The connector C1 is fixed to the main line A1 by winding a fixing member 60 such as a tape, clip, cable tie, strap band or the like. The branch lines B are drawn out from the main line A1 and cut, and one or more terminals 20 are connected electrically with end portions of the branch lines B. The terminals 20 are inserted into the respective cavities 11. Thus, the terminals 20 are connected while being shorted by a busbar 30. Therefore, the branch lines B are connected electrically via the busbar 30.

The device includes the device-side wire W1. The terminal 20 is to be connected electrically with an end portion of the device-side wire W1. The connector C1 is formed with one or more (e.g. four) cavities 11, part of (e.g. two) cavities 11 are or may be empty when the terminals 20 of the branch lines B connected with the connector C1. Thus, the terminal 20 of the device-side wire W1 is inserted into either one of the empty cavities 11, as shown in FIG. 19, and is connected electrically with the terminals 20 of the branch lines B via the busbar 30. In this way, the branch lines B are connected electrically with the device-side wire W1 via the busbar 30 and the terminals 20. In this way, the branch lines B are branch-connected with the device-side wire W1.

As described above, it is sufficient to insert the terminal 20 of the device-side wire W1 into the cavity 11 of the connector C1 for branch connecting the branch lines B with the device-side wire W1 via the busbar 30. Additionally, connection reliability of aluminum wires can be improved as compared with branch connection of the branch lines B with the device-side wire W1 using insulation displacement terminals. Therefore, the device can be attached later if necessary.

Figure 20:
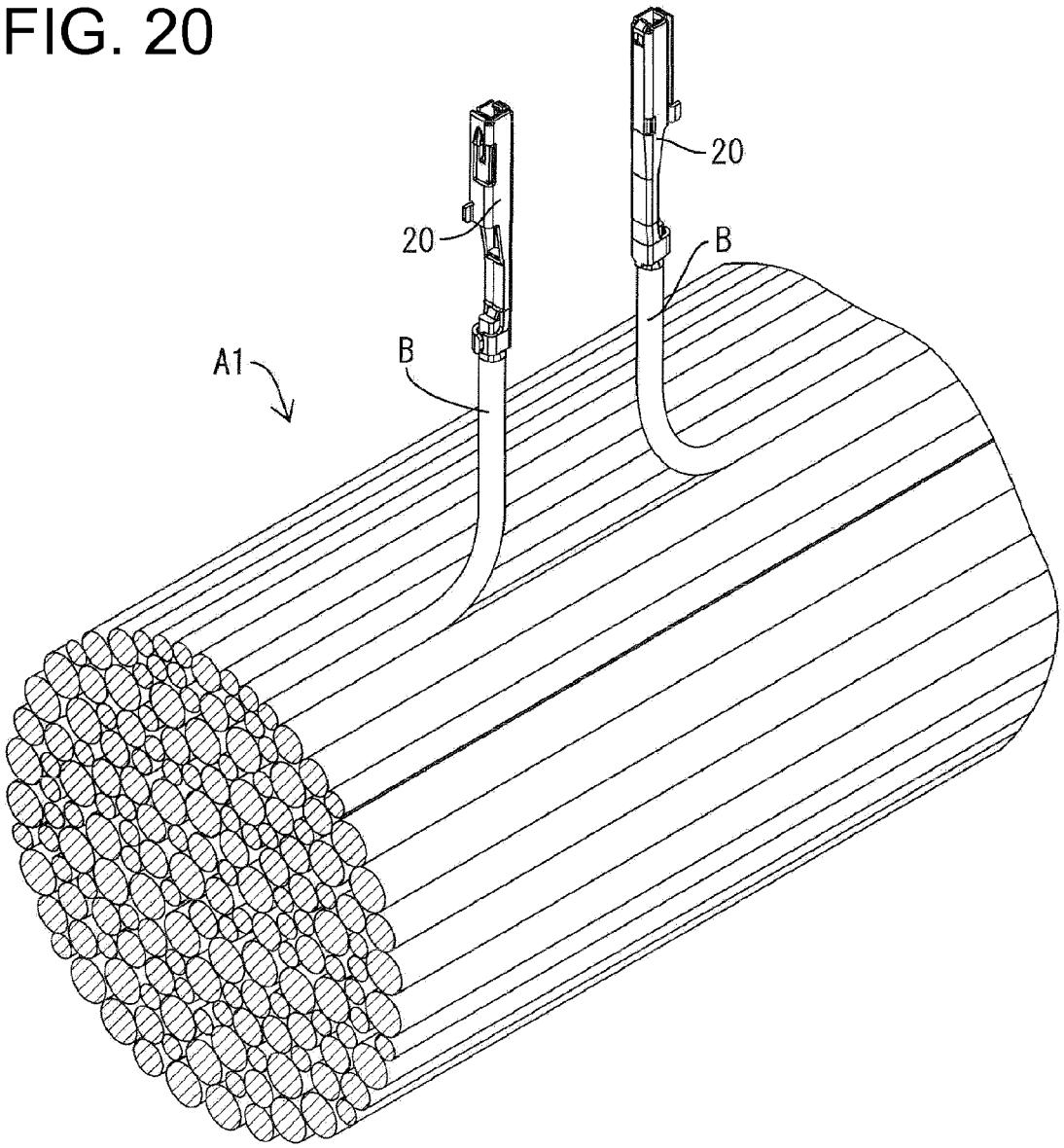
FIG. 20 is a perspective view showing a state where a terminal is connected with an end portion of a branch line drawn out from a main line in a fourth embodiment.
Figure 21:
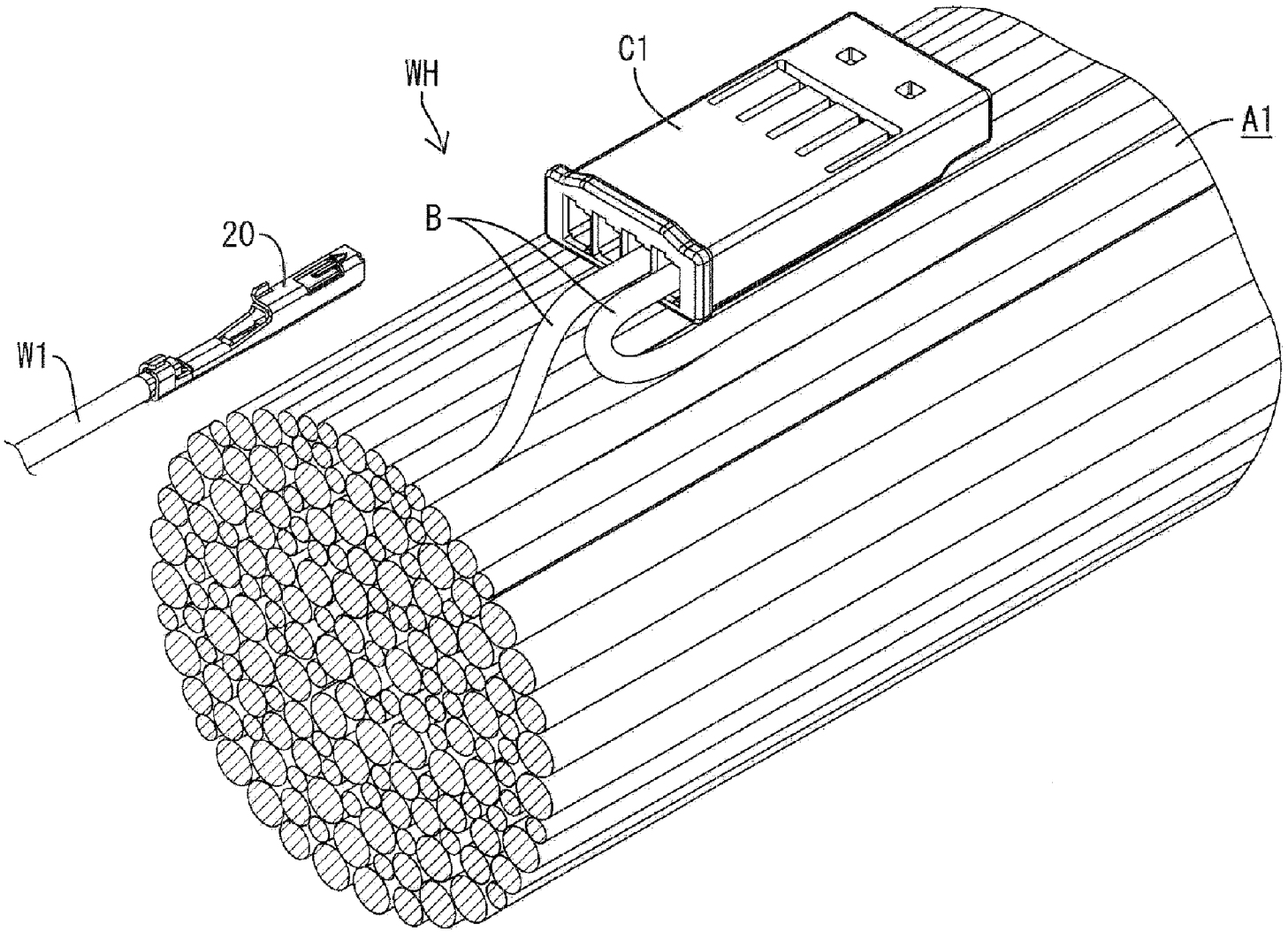
FIG. 21 is a perspective view of a wiring harness showing a state before a terminal of a device-side wire is connected with a connector.
Figure 22:
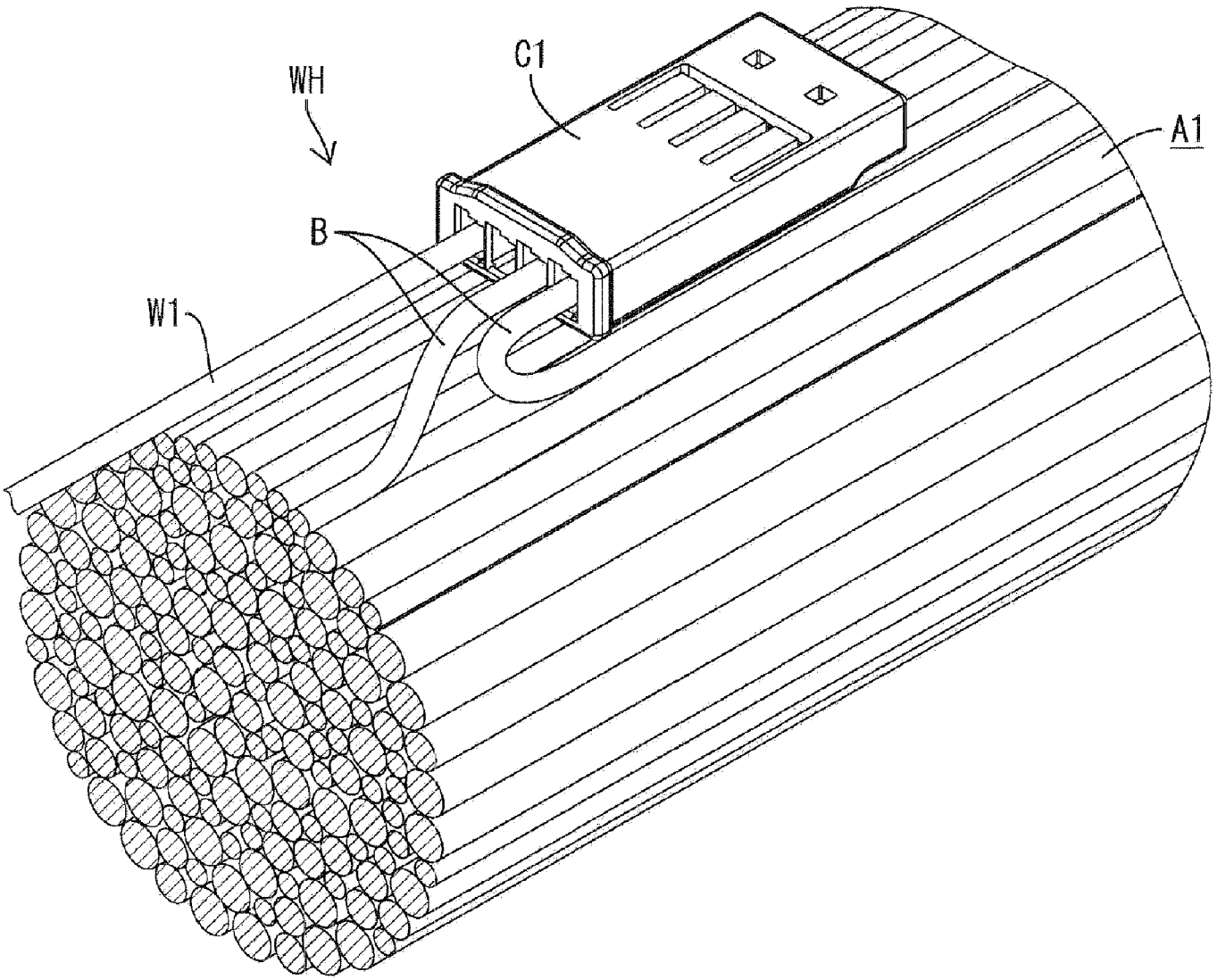
FIG. 22 is a perspective view of the wiring harness showing a state where the terminal of the device-side wire is connected with the connector.

A fourth preferred embodiment of the invention is illustrated in FIGS. 20 to 22. In this embodiment, unlike the third embodiment, a connector C1 is not mounted on a main line A1 beforehand and a branch line B from the main line A1 is branch-connected using the connector C1 when it is necessary to attach a device later. Elements that are the same as or similar to the first embodiment are identified by the same reference numerals, but are not described again. A wiring harness WH of this embodiment preferably uses the main line A1 made of aluminum wires and is similar to the third embodiment in this respect.

As shown in FIG. 20, the necessary branch line B is drawn out from the main line A1 and cut. Terminals 20 then are connected electrically with both end portions of the cut branch line B and are inserted respectively into cavities 11 of the connector C1, as shown in FIG. 21. In this way, both terminals 20 are connected while being shorted via a busbar 30 and the branch line B is connected electrically via the busbar 30 to complete the wiring harness WH is completed.

On the other hand, as shown in FIG. 22, a terminal 20 is connected electrically with an end portion of a device-side wire W1 and is inserted into a cavity 11 of the connector C1. The terminal 20 of the device-side wire W1 then is connected electrically with the terminals 20 of the branch line B via the busbar 30. In this way, the branch line B is connected electrically with the device-side wire W1 via the terminals 20 and the busbar 30, and hence is branch-connected with the device-side wire W1.

As described above, in this embodiment, connection reliability of aluminum wires can be improved as compared with branch connection of the branch line B with the device-side wire W1 using insulation displacement terminals. Further, the device can be attached later if necessary even when the connector C1 is not mounted on the main line A1 beforehand.

The invention is not limited to the above described and illustrated embodiments. For example, the following embodiments are also included in the technical scope of the present invention.

The leading end surfaces of the locking lances 12 at the engaging positions and the facing surface 15A of the housing 10 are substantially parallel in the above embodiments. However, the leading end surfaces of the locking lances and the facing surface of the housing may be at different inclinations.

The catches 50 are recesses formed in the leading end surfaces of the locking lances 12 in the second embodiment. However, the catches may be of any form provided that they are engageable with the leading end of the disengaging jig. For example, a plurality of fine lateral grooves or a plurality or projections may be formed at the leading ends of the locking lances.

Although the main line A1 made up of the aluminum wires is illustrated in the third and fourth embodiments, a main line made up of copper wires may be used according to the present invention. In this case, the branch line B and the device-side wire W1 may be connected directly connected using an insulation displacement terminal instead of using the terminals 20 and the busbar 30.

What is claimed is:

1. A connector, comprising:

a housing internally formed with at least one cavity capable of accommodating a terminal inserted in a rearward to forward direction, the housing having an outer wall with an inner surface facing the cavity and an outer surface facing away from the cavity, and an opening formed in the outer wall;

at least one locking lance formed at the outer wall of the housing and projecting forwardly into the opening, the locking lance being resiliently deformable between an engaging position to engage the terminal in the cavity and a disengaging position outwardly from the engaging position to permit insertion and withdrawal of the terminal, a leading end surface of the locking lance being inclined to project gradually forward toward an inner side of the housing;

a facing surface being defined on the outer wall of the housing substantially at the opening and facing the leading end surface of the locking lance the facing surface being inclined to project gradually toward the locking lance at more outward positions on the outer wall so that an outer and rear part of the facing surface is outward and rearward of an inner forward part of the leading end surface of the locking lance; wherein the leading end surface of the locking lance contacts the facing surface of the outer wall when the locking lance is deformed outward beyond the disengaging position for preventing excessive outward deformation of the locking lance.

2. The connector of claim 1, wherein the locking lance is configured so as not to project out from the housing at the engaging position and to project out from the housing when deflected outward from the engaging position.

3. The connector of claim 1, wherein at least one catch is provided at the leading end surface of the locking lance and engageable with a jig.

4. The connector of claim 3, wherein the catch is provided in the widthwise center of the locking lance.

5. The connector of claim 3, wherein the catch comprises at least one recess in the front end surface of the locking lance, and a recessing direction thereof being substantially parallel to the outer wall (10B) of the housing when the locking lance is at the engaging position.

6. The connector of claim 1, wherein inclinations of the facing surface and the front end surfaces of the locking lances are substantially the same.

7. The connector of claim 1, wherein an inclination of the front end surface of the locking lance is substantially equal to an inclination of an engageable portion of the terminal.

8. The connector of claim 1, wherein a detecting jig can be slid along the outer wall of the housing without being hindered if the terminal has been inserted to a proper position in the cavity , whereas the detecting jig contacts the front end surface of the locking lance if the terminal is inserted insufficiently into the cavity.

9. The connector of claim 1, wherein the outer wall of the housing has at least one opening for exposing the at least one cavity to an outer side of the housing.

10. The connector of claim 9, wherein a clearance between the leading end surface of the locking lance and the opening serves as a jig hole, into which a jig is at least partly insertable.

11. A wiring harness enabling at least one device-side wire to be connected with at least one main line formed by bundling a plurality of branch lines, comprising:

the connector of claim 1;

a main line;

at least one fixing member for fixing the connector to an outer surface of the main line; and a busbar provided in the connector for shorting the branch line drawn out from the main line with a device-side wire.

12. A wiring harness enabling at least one device-side wire to be connected with at least one main line formed by bundling a plurality of branch lines, comprising:

a connector having a housing internally formed with at least one cavity capable of accommodating a terminal, at least one locking lance formed at the outer wall of the housing and being resiliently deformable between an engaging position to engage the terminal in the cavity and a disengaging position outwardly from the engaging position to permit the insertion and withdrawal of the terminal, a leading end surface of the locking lance being inclined to project gradually forward toward an inner side of the housing, a facing surface of the outer wall of the housing substantially facing the leading end surface of the locking lance being inclined to project gradually toward the locking lance at more outward positions on the outer wall, the leading end surface of the locking lance contacting the facing surface when the locking lance is deformed outward beyond the disengaging position for preventing excessive outward deformation of the locking lance, and a busbar for shorting wires, and the branch line drawn out from the main line is connected with the connector and the device-side wire is connected with the connector, whereby the device-side wire and the branch line are shorted by the busbar.

13. A connector, comprising a housing with opposite front and rear ends and an outer wall extending in a front to rear direction, at least one cavity extending through the housing from the rear end to the front end and substantially in the front to rear direction, at least one locking lance cantilevered forward in the outer wall of the housing and being resiliently deformable between an engaging position where an engaging portion of the locking lance projects into the cavity and a disengaging position where the engaging portion is adjacent the cavity, part of the locking lance projecting out beyond the outer wall when the locking lance is at the disengaging position, the locking lance having a leading end surface aligned oblique to the front to rear direction so that more inward positions on the leading end surface are closer to the front end of the housing and the outer wall having a facing surface substantially opposed to and outwardly of the leading end surface of the locking lance, a portion of the facing surface being rearward of at least a portion of the leading end surface of the locking lance so that the facing surface of the outer wall contacts the leading end surface of the locking lance to prevent deformation of the locking lance outward beyond the disengaging position.

14. The connector of claim 13, wherein the leading end surface of the locking lance and the facing surface of the outer wall are substantially parallel.

15. The connector of claim 13, further comprising at least one recess at the leading end surface of the locking lance.

16. A connector, comprising:

a housing with opposite front and rear ends and an outer wall extending in a front to rear direction having an outer surface and an inner surface, at least one cavity extending through the housing from the rear end to the front end and substantially in the front to rear direction;

at least one terminal insertable into the cavity; and at least one locking lance cantilevered forward in the outer wall of the housing and being resiliently deformable between an engaging position where an engaging portion of the locking lance projects into the cavity and locks the terminal in the cavity when the terminal is at a proper insertion position in the cavity and a disengaging position where the engaging portion is deflected out of the cavity for permitting insertion of the terminal, the locking lance having a leading end surface aligned oblique to the front to rear direction so that more inward positions on the leading end surface are closer to the front end of the housing and the outer wall having a facing surface substantially opposed to and outwardly of the leading end surface of the locking lance, an outward portion of the facing surface contacting the leading end surface of the locking lance to limit deflection of the locking lance outward beyond the disengaging position.

17. The connector (C1; C2) of claim 16, wherein no part of the locking lance (12) projects out from the outer wall (10B) when the locking lance (12) is at the engaging position, and wherein part of the locking lance (12) projects out beyond the outer wall (10B) when the locking lance (12) is at the disengaging position.

18. The connector of claim 16, wherein the leading end surface of the locking lance and the facing surface of the outer wall are substantially parallel.

19. The connector of claim 16, further comprising at least one recess at the leading end surface of the locking lance.

20. The connector of claim 16, wherein an inclination of the front end surface of the locking lance is substantially equal to an inclination of an engageable portion of the terminal.

* * * * *